United States Patent [19]

Uyeda

[11] Patent Number: 4,493,199

[45] Date of Patent: Jan. 15, 1985

[54] UNIVERSAL BOLTWORKS MECHANISM FOR SAFE DOOR

[75] Inventor: Tim Uyeda, South San Gabriel, Calif.

[73] Assignee: La Gard, Inc., Torrance, Calif.

[21] Appl. No.: 420,712

[22] Filed: Sep. 21, 1982

[51] Int. Cl.[3] ..... E05B 15/16; E05B 63/00

[52] U.S. Cl. ..... 70/333 R; 70/1.5; 70/462

[58] Field of Search ..... 70/1.5, 119, 303 A, 70/303 R, 302, 333, 462; 109/30, 34

[56] References Cited

U.S. PATENT DOCUMENTS

| | | | |
|---|---|---|---|
| 1,736,205 | 11/1929 | Macy | 109/30 |
| 2,494,575 | 1/1950 | O'Brien . | |
| 3,158,017 | 11/1964 | Guze, Jr. | 70/1.5 X |
| 3,968,667 | 7/1976 | Gartner | 70/303 A |
| 3,991,596 | 11/1976 | Gartner | 70/303 A |
| 4,127,995 | 12/1978 | Miller | 70/303 R X |
| 4,233,913 | 11/1980 | Herrmann | 70/1.5 X |
| 4,342,207 | 8/1982 | Holmes et al. | 70/119 |
| 4,393,790 | 7/1983 | Bagwell | 70/1.5 X |

*Primary Examiner*—Gary L. Smith
*Assistant Examiner*—Thomas J. Dubnicka
*Attorney, Agent, or Firm*—Poms, Smith, Lande & Rose

[57] ABSTRACT

A universal boltworks mechanism is compatible for use with any of a range of shapes and sizes of safe door and is alternatively enclosed in an easily fabricated centrally located bore on the interior surface of the safe door or in a pan enclosure which is easily welded to the interior of the safe door. The mechanism particularly includes a universal cam member which is configured such that it may be used without adaptation with any of said shapes and sizes of safe door alternatively driving three bolt driving structures of a first configuration on one side thereof and four bolt driving structures of a second configuration on the other side thereof. The universal boltworks mechanism is also provided with a bolt inhibitor which inhibits unlocking movement of each bolt whenever a breakaway portion of the mounting enclosure cover plate has been broken away in response to tampering forces in excess of a predetermined amount.

16 Claims, 27 Drawing Figures

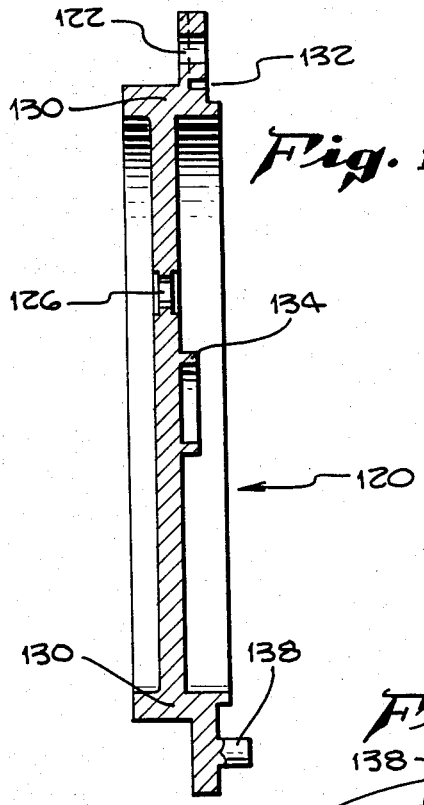
Fig. 11.
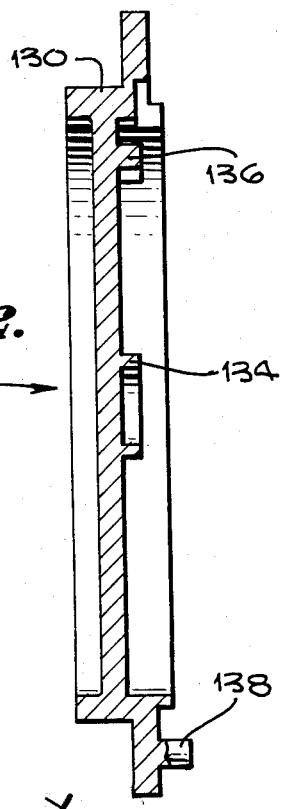
Fig. 12.
Fig. 10.
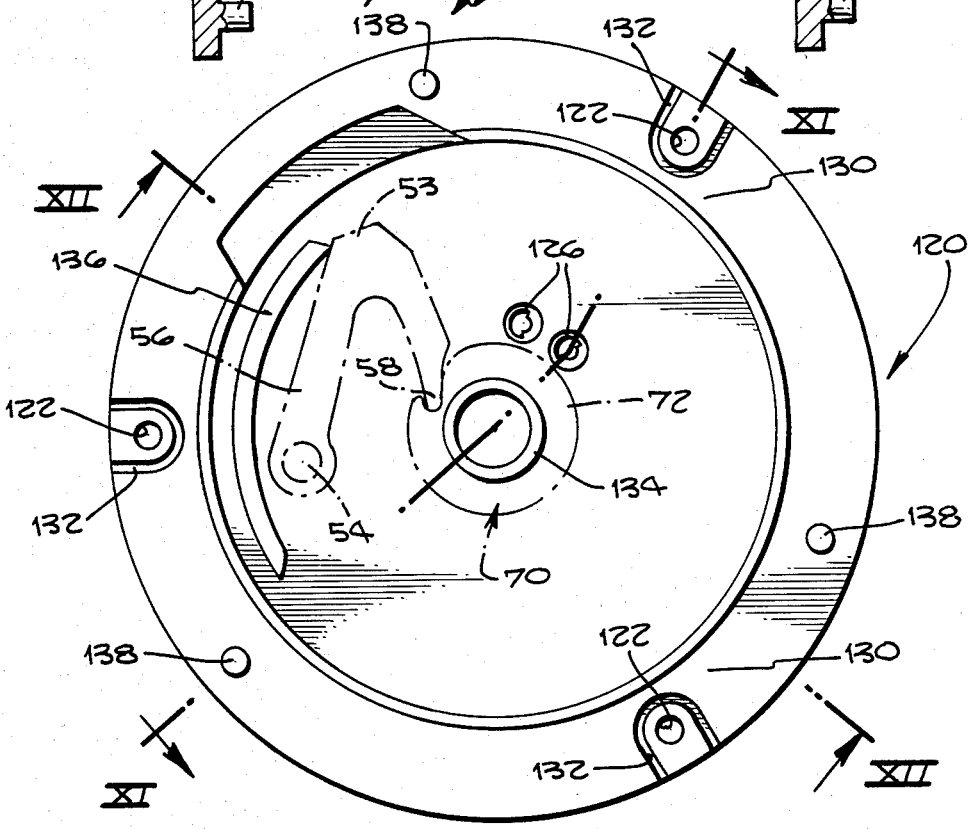

Fig. 16.
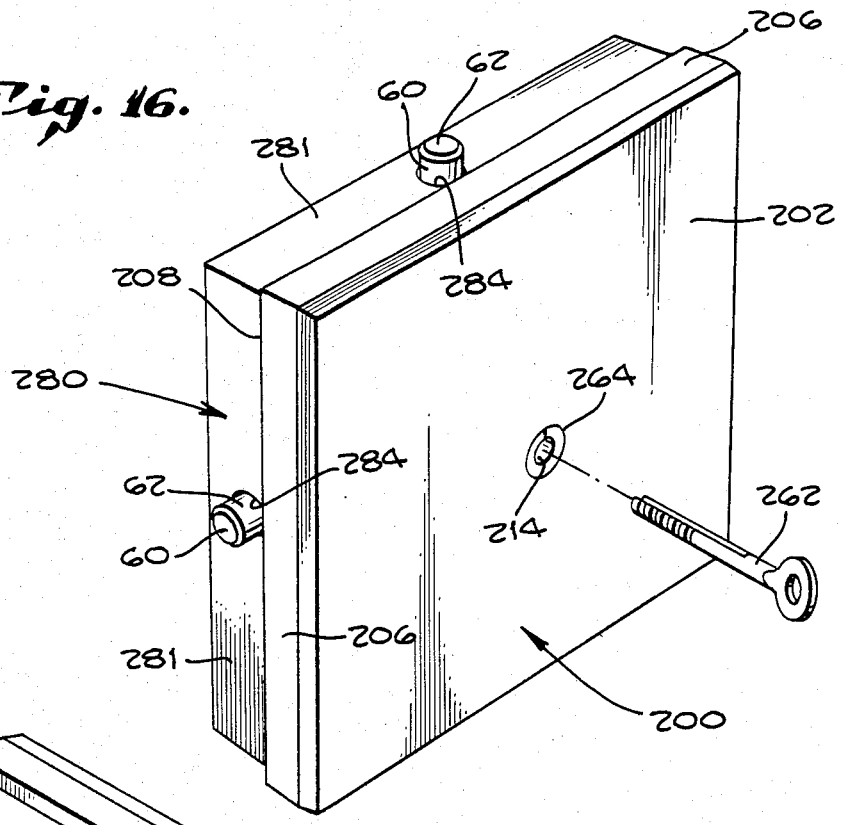
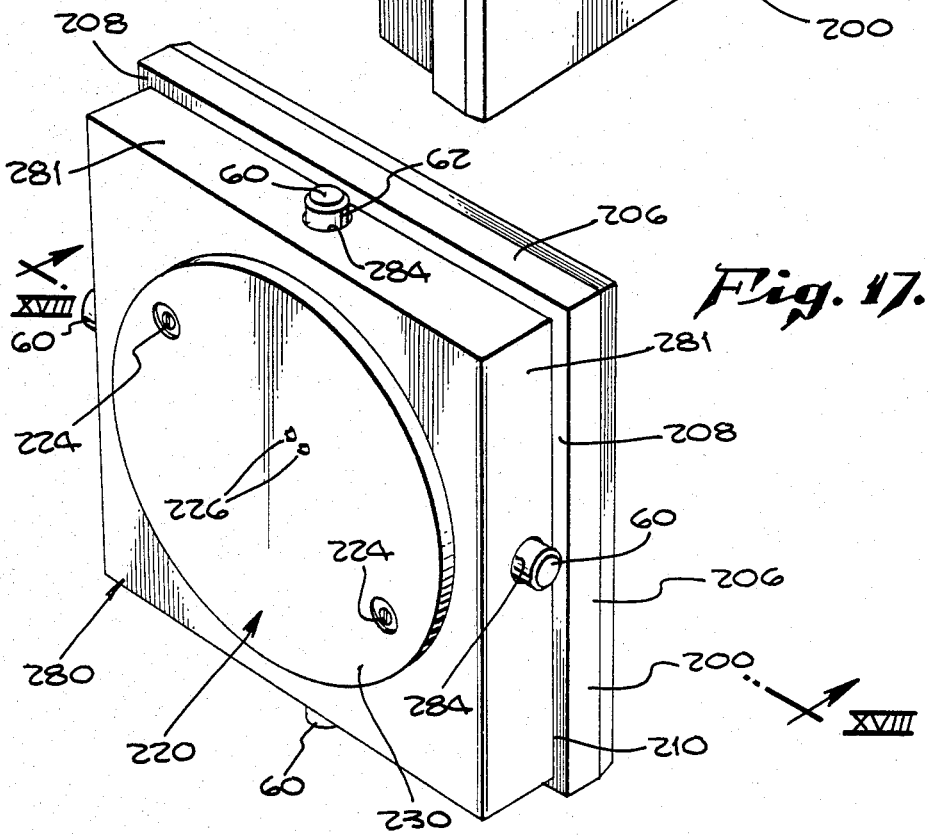
Fig. 17.

UNIVERSAL BOLTWORKS MECHANISM FOR SAFE DOOR

The present invention relates generally to locking mechanisms for safe doors and, more particularly, to boltworks mechanisms mounted to safe doors for retracting multiple locking bolts from a frame surrounding the safe door is response to a proper unlocking manipulation of a door-mounted lock mechanism.

BACKGROUND OF THE INVENTION

Providing security for one's possessions and, thus, safemaking is one of the oldest trades known to man. Today the provision of security for personal property is a multi-million dollar industry. Through its history there have been many improvements in different aspects in the design and construction of safes appropriate for use in a home or small business. For instance, the enclosure has evolved from the simple construction of a heavy box by a blacksmith to the development of a modern hardened and insulated steel enclosure. Similarly, lock mechanisms have evolved from one or two toothed key activated devices to complex multiple-tumbler, magnetic, timer or combination type lock mechanisms. All of these improvements, however, have centered around one design aspect which has remained substantially unchanged, namely, that the construction of a safe consists of a provision of an impenetrable box of a convenient size and shape, a door which may engage and seal the box in a closed and locked condition, multiple bolts which extend typically from the door outwardly into apertures in the door frame of the safe enclosure, and a lock mechanism which causes or permits movement of the bolts to an unlocked or frame disengaged position only in response to a predetermined manipulation which signifies that the manipulator has either the proper key or knowledge of the proper combination of manipulations of the lock mechanism as evidence of the propriety of his access to the contents of the safe.

Due to the special nature of the construction of safes, a guild-type profession developed over the history of safes relating to their assembly. This professional, loosely referred to as a boltworks, utilized carefully guarded trade secrets acquired in an apprentice relationship to take a strongbox constructed by a blacksmith, a lock mechanism constructed by a locksmith and assemble these together with locking bolts and a boltworks mechanism to produce an operating safe. Typically, these boltworks mechanisms had to be custom designed and made to conform to the specific shape and size of the safe door to which they were being mounted. They further required specific adaptation to be compatible with the specific lock mechanism which was selected and mounted for operating the safe.

Lock mechanisms have recently been standardized in that many mechanisms are manufactured with a standardized driving assembly which rotates in response to proper unlocking manipulation irrespective of the size, complexity or design of the lock mechanism thereby becoming suitable for mass manufacturing and assembly into prefabricated boltwork mechanisms. Prior to the present invention, however, boltworks mechanisms were still custom designed to have a size and shape appropriate to a specific compatible design of safe door. Thus, a modern purchaser of a safe had three alternatives. He may purchase an off the shelf safe having a combination of strongbox dimensions, construction, door shape and lock mechanism which individually are not of his choosing and adapt it to his purposes. This alternative also has its vulnerabilities by virture of its mass manufacture and on the shelf availability for inspection by anyone including a thief. He may purchase a custom-designed safe enclosure in terms of box dimension and construction materials but have it designed to utilize a standard-sized mass manufactured off-the-shelf safe door having a limited selection of lock mechanisms. Again, with this more costly alternative, the vulnerabilities of the lock mechanisms would be known to a thief upon seeing the standard make of safe door. Third, he may purchase a custom designed safe enclosure and door and employ a boltworks to create a custom-design boltworks mechanism adapted to the particular custom-sized safe door and enclosure for using a concealed lock mechanism of his choosing. For those purchasers who could not use a standard size or shape of safe door for a particular application or would not risk having the vulnerability of the lock mechanism known by its identification as the mechanism used with a particular make of standard-sized safe door, this third and only available alternative, prior to the present invention, was quite costly in requiring the manufacture of a custom-designed boltworks mechanism.

It is thus an object of the present invention to provide a universal boltworks mechanism which is a single mechanism design that is compatible with safes having a variety of shapes and sizes of safe doors and is thus suitable for low-cost manufacturing. It is a further object of the invention to disclose and provide a universal boltworks mechanism which may be simply and easily installed by the blacksmith fabricating the safe enclosure thereby eliminating the necessity of engaging a professional boltworks to complete the assembly. It is yet another object of the present invention to provide a standardized boltworks mechanism which is mountable to the interior side of a custom-made safe door such that the particular lock mechanism used, and thus its vulnerabilities, would not be identifiable to a thief merely by viewing the exterior of the safe door.

One aspect of the boltworks profession is the design and construction of a mounting apparatus for mounting the lock mechanism and the door frame engaging bolts to a safe door in a manner which resists accessability to a potential thief. While the door and safe enclosure may be formed of a thick and impenetrable material, there are points of exposure or vulnerability in the construction which must be protected by the boltworks mechanism. Specifically, some portion of the boltworks and lock mechanism must be accessible to the exterior of the safe in order to be manipulable and thus opened by a proper sequence of lock manipulations. Typically, this has meant that a portion of the lock mechanism must be exposed to the exterior through an aperture in the safe door, for example, a tumbler mechanism activated by a key or a combination dial and shaft of a combination lock mechanism. It is known in the art for lock mechanisms themselves to make them resistant to tampering at the point of external access such as the keyway or the shaft of the combination lock and that tampering in this immediate area will cause disablement or disassembly in a locked condition resisting theft of the safe contents. These mechanisms, however, still require protection from access from other directions and for this rely on their associated boltworks mechanism and the enclosure structure of the safe door to prevent tampering access to the mechanism. One such technique of tampering is the drilling of an access hole adjacent to a combination lock mechanism through which a fiber-optic light and scope may be inserted to view the action of the tumbler wheels of the combination lock mechanism and thereby determine the opening combination. Similarly, pounding or hammering of the entire lock mechanism away from the interior of the safe door has in some constructions been a sucessful technique for overcoming the lock mechanism and gaining access to the boltworks whereby manipulation of the boltworks through the aperture of the safe door unlocks the door.

It is therefore yet another object of the present invention to disclose and provide a universal boltworks mechanism which resists tampering of the type just described, preventing access to a combination lock mechanism by a fiber-optic scope or unlocking manipulation of a boltworks mechanism by hammering or drilling or otherwise disabling the lock mechanism itself.

SUMMARY OF THE INVENTION

Simply stated, the present invention comprises a universal boltworks mechanism for use with a safe having any of a range of sizes and shapes of safe door. The mechanism includes a universal cam member which drives multiple door-mounted bolts between locking and unlocking positions of engagement with the frame of the safe enclosure only in the response to proper unlocking manipulation of the lock mechanism mounted to the safe door.

More specifically, the present invention comprises a single mechanism which is universal in its application both as to the lock mechanism which it is used with as well as the size and shape of safe door to which it is mounted. Essentially, the universal boltworks mechanism is mounted to the interior surface of a safe door and contains any one of a variety of compatible lock mechanisms, the lock mechanisms being compatible by the provision of a driving assembly of a standarized geometry, the driving assembly being rotatable only in response to proper unlocking manipulation of the lock mechanism. The universal boltworks mechanism includes a universal cam member which is rotatably mounted about a driving shaft for selective rotation therewith in response to operation of the driving assembly, a mounting enclosure, and a plurality of door locking bolts mounted within the enclosure and driven by the universal cam member into engaged and disengaged positions with respect to the door frame of the safe to which the safe door is mounted.

In accordance with one feature of the present invention, the universal cam member has single-piece construction and may be cast or formed of an inexpensive and lightweight material. The cam member has a generally disk-like shape with a centrally-located aperture adapted to receive the standard geometry driving shaft of the lock mechanism selected for use therewith. By this feature, any of a variety of types of lock mechanisms may be selected for use including combination locks which are unlocked by a sequence of rotations of an externally mounted combination dial or key locks in which insertion of a key positions multiple tumblers contained in the lock mechanism to desired positions permitting rotation of a cylinder portion of the lock. Any type or style of mechanism may be compatible so long as its geometry fits within certain maximum dimensions and the proper unlocking sequence results in a limited rotation of a particular geometry of driving assembly mounted inwardly with respect to the safe door.

In accordance with another feature of the present invention, the universal cam member is provided with a plurality of bolt driving structures which are connected with pins associated with the plurality of bolts mounted into the universal boltworks mechanism enclosure, the pins and interconnecting structure causing those bolts to move inward and outward with respect to the safe door and thus into and out of locking engagement with the safe door frame. In one embodiment, one side of the universal cam member is provided with three bolt driving structures while the other side of the universal cam member is provided with four bolt driving structures. By this feature the universal cam member may be used with either a circular-shaped safe door or a rectangular-shaped safe door in which three or four frame-engaging and locking bolts are used, respectively. The adaptation of the single cam member for use with either of the safe doors can be accomplished either by variation of the linkage used to connect the bolts to the driving structures or by changing the orientation of the cam member alone.

Further in accordance with this second feature, rather than an alternative embodiment of changing the orientation of the universal cam member in order to adapt it for use with a circular or rectangular safe door, respectively, in a preferred embodiment the universal cam member is mounted to the lock mechanism driving shaft in only one orientation and the cam member is provided with three equiangularly displaced bolt driving structures on one side and four equiangularly displaced bolt driving structures on the other side. In accordance with this embodiment, the three bolt driving structures have a first configuration and the four bolt driving structures on the opposite side of the cam member have a second configuration. In accordance with either one of these two configurations, the door frame engaging bolts are linked to the universal cam member for causing inward and outward motion in response to rotation to the universal cam member.

The multiple bolt driving structures of the first configuration comprise multiple apertures in the cam member positioned equiangularly with respect to each other and proximate the periphery of the universal cam member. The apertures are defined by cylindrical bores into a raised boss of the universal cam member, each of said bores having an axis parallel to the axis of the aperture which mounts the universal cam member upon the lock mechanism driving shaft. Each of these apertures is adapted to receive a pin portion of a linkage which is pivotally mounted with respect to a particular bolt to be driven by the bolt driving structure. Accordingly, the linkage is pivotally mounted with respect to the universal cam member by the positioning of the pin portion of the linkage within the aperture of the bolt driving structure and in this manner rotation of the universal cam member by action of each of the respective linkages produces inward and outward motion of each of the door frame engaging bolts in unison.

In accordance with the second configuration, the universal cam member mounted in the same orientation as in the first configuration for driving the door frame engaging bolts is provided with multiple bolt driving structures which are each in the form of an inwardly spiraling groove with respect to the axis of the aperture which mounts the universal cam member to the lock mechanism driving shaft and are each on the opposite side of the cam member from the bolt driving structures of the first configuration. According to the second configuration, the cam member and each of the respective door frame engaging bolts are mounted so that a bolt-associated pin of each bolt is positioned within a respective spiral groove such that rotation of the universal cam member by the interaction of the bolt-associated pin and the spiral groove causes inward and outward movement in unison of each of the door frame engaging bolts. By alternatively using the direct bolt and cam linkage of the second configuration or using the interconnecting linkage member between the bolt and cam of the first configuration, the same universal cam member mounted in the same orientation can alternatively drive an even-numbered plurality of bolts, a geometry best suited for rectangular doors, or an odd-numbered plurality of bolts, a geometry best suited for circular doors.

In accordance with another feature of the present invention and in order to prevent improper tampering with the lock mechanism, the universal cam member as used with the just-described preferred embodiment is further provided with a skirt portion integral with the universal cam member and extending circumfrentially about the exterior of the lock mechanism when mounted on the driving shaft of the lock mechanism. The shirt functions as a shield which prevents penetration or observation into the lock mechanism by drilling apparatus or fiber optics, thereby ensuring proper protective operation of the lock mechanism.

In accordance with yet another feature of the present invention, the universal cam member is configured to permit easy assembly and installation of the universal boltworks mechanism. The universal cam member is thus formed with four equiangularly displaced bolt driving structures of the first configuration together with the circumfrential protective skirt mounted on the one side of the cam member which engages the lock mechanism and faces the interior surface of the safe door. The universal cam member is further provided with three equiangularly displaced bolt driving structures of the second configuration on the opposite side of the member.

This mechanism may be assembled and mounted either directly into an interior bore of the safe door under a cover plate or may be preassembled in a mounting enclosure or pan which is simply attached or welded to the interior surface of the door. By either method of mounting, the mechanism and be easily assembled for use with a square door as follows: a preselected lock mechanism with driving shaft is positioned either in the enclosure or in the interior bore of the safe door; four bolts are inserted into channels or guides such that they are extendable from the four edges of the enclosure or the door, these bolts being either selected for size or cut to a length corresponding with the size of the safe door to which they will be applied; a universal cam member is slid onto the driving shaft of the lock mechanism; four bolt driving linkages in accordance with the second configuration are positioned such that one pin portion of each linkage is positioned to pivot within its respective bolt associated aperture and the other pin portion of each linkage is positioned to pivot within the aperture of the respective bolt driving structure on the universal cam member; and a cover plate is positioned and mounted to enclose the boltworks assembly either within the square enclosure or the safe door.

This same mechanism can easily be assembled for use with a circular safe door as follows: the selected lock mechanism is positioned centrally in the interior of a circular shaped boltworks mechanism enclosure or pan or in the interior bore of a circular safe door; three bolts which are selected or cut to a preselected length corresponding with the diameter of the circular safe door are slideably mounted in guides or channels for sliding inwardly or outwardly with respect to the safe door; the universal cam member is positioned on the driving shaft of the lock mechanism in such a manner that the three equiangularly displaced inwardly spiraling grooves of the bolt driving structure in accordance with the second configuration engage the bolt-associated pins of each of the three equiangularly displaced bolts; and the assembled mechanism is enclosed by positioning and attaching a cover plate onto the circular enclosure or the interior surface of the safe door.

In accordance with still another feature of the present invention, the universal boltworks mechanism is further made tamper resistant and impervious to theft by the provision of a cover plate having a breakaway portion which causes partial and disabling disassembly of the universal boltworks mechanism. It is specifically contemplated that this feature would inhibit bolt motion restraining it in the locked condition whenever any excessive force exerted on the lock mechanism or any other portion of the boltworks mechanism, such as would occur during hammering or tampering with the lock mechanism or drilling through the safe door into the interior portions of the boltworks mechanism, exceeded a preselected threshold. In accordance with this feature, forces in excess of a predetermined threshold level would be transmitted by the lock mechanism and the boltworks mechanism to the breakaway portion of the cover plate causing it to be broken away so that it falls into the interior of the safe. Once the cover has broken away and fallen inward, partial disassembly would result including operation of bolt inhibitors located proxiate each of the door frame engaging bolts. In one embodiment, spring-loaded bolt inhibitors would be released such that they would extend into a circumfrencial groove of the respective bolt and thereby inhibit the bolt from unlocking motion out of engagement with the door frame, thereby rendering the boltworks mechanism disabled in a safe-locked condition and frustrating the theft attempt.

It is still another object of the present invention to provide a universal boltworks mechanism which is compatible with a variety of sizes of safe doors within a predetermined range of sizes. According to this feature, this is easily accomplished by a provision of a universal boltworks mechanism within an enclosure which may easily attached to a interior surface of any such size of safe door, the mechanism having door frame engaging bolts mounted therein of an extended length which may be easily cut by the safe constructing blacksmith to a length corresponding to the dimensions of the safe door which the mechanism is intended to be used with. After cutting the bolts to size, the boltworks mechanism may be simply welded to the interior surface of the safe door such that a portion of the lock mechanism extends through an externally accessible aperture to permit unlocking manipulation. In an alternative embodiment in accordance with this feature, the same universal boltworks mechanism enclosure, cam member, and linkages, if necessary depending on the geometry of the safe door, could be pre-assembled in combination with various lengths of door frame engaging bolts in increments corresponding with the more commonly requested sizes for custom fabricated safes for installation by the safe constructing blacksmith.

It will seen by one skilled in the art that each of the foregoing objects may be accomplished by embodiments of the present invention which include various combinations of the above-mentioned features. A more complete understanding of the present invention can be had by a detailed review of the accompanying drawings and a detailed description of preferred embodiments, as follows.

BRIEF DESCRIPTION OF THE DRAWINGS

FIG. 10 is a front view of the cover plate portion of the universal boltworks mechanism of FIG. 3.

FIG. 11 is a side sectional view of the cover plate of FIG. 10 taken in section along plane XI—XI of FIG. 10.

FIG. 12 is another side sectional view of the cover plate of FIG. 10 taken in section along plane XII—XII of FIG. 10.

FIG. 16 is a perspective view of the outward facing side of a square shaped safe door provided with a key operated lock mechanism and carrying an embodiment of the universal boltworks mechanism of the present invention.

FIG. 17 is a perspective view of the inward facing side of the safe door of FIG. 16.

DETAILED DESCRIPTION OF EXEMPLARY EMBODIMENTS

The present invention consists of a universal boltworks mechanism which is compatible and intended for use with a variety of sizes and shapes of safe doors as well as various types of lock mechanisms. FIGS. 1-13 show the use of the universal boltworks mechanism, including the universal cam member of FIGS. 14 and 15, assembled in a first configuration for use with a circular shaped safe door as specifically shown in FIGS. 1 and 2. FIGS. 16-27 show the use of the universal boltworks mechanism, including the same universal cam member, assembled in a second configuration for use in a rectangular shaped safe door such as the square shaped door specifically shown in FIGS. 16 and 17.

For ease of reference, part numbers 1-99 will be used to describe certain parts of the universal boltworks mechanism and their features which are compatible and adaptable for use with either circular or rectangular shaped safe doors. These part numbers will be used consistently throughout each of the figures. Part numbers 100-199 will be used to designate certain parts or their features specific to the first configuration of assembly of the universal boltworks mechanism and use with the circular-shaped safe door of FIGS. 1-13. Similarly, part numbers 200-299 will be used to designate certain parts or their features specific to the second configuration of assembly of the universal boltworks mechanism and use with a rectangular-shaped safe door such as the square-shaped safe door of FIGS. 16–27.

Two embodiments are illustrated and described with the understanding, as will become apparent, that the features shown may be combined into multiple permutations which are equally preferable.

Figure 14:
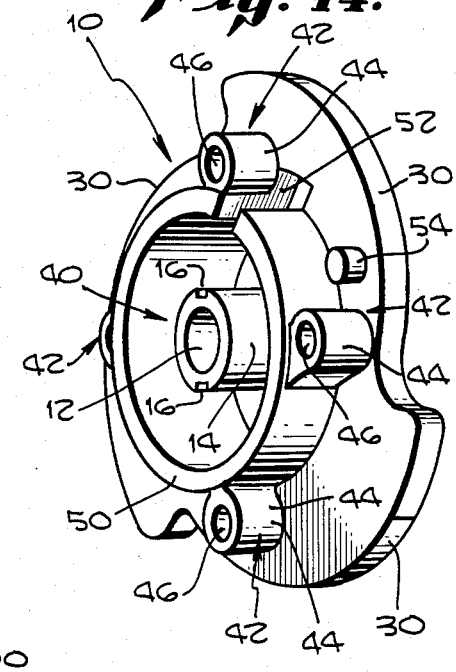
FIG. 14 is a perspective view of one side of the universal cam member feature of the present invention for use in the universal boltworks mechanism of the present invention.
Figure 15:
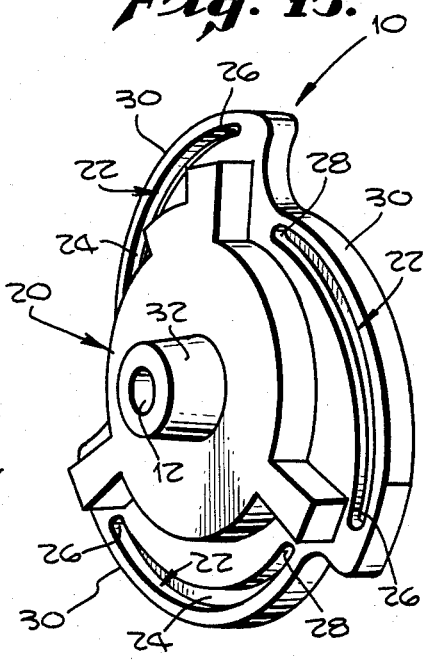
FIG. 15 is a perspective view of the other side of the universal cam member of FIG. 14.

FIGS. 14 and 15 illustrate a central feature of the universal boltworks mechanism of the present invention, specifically the universal cam means which includes the universal cam member, indicated generally at 10, which is shown in a preferred embodiment suitable for use with either of two assembly configurations of the universal boltworks mechanism, as will be more fully discussed. The universal cam member 10 has roughly a disk-like shape with a first side 20 which is typically mounted adjacent the interior surface of the safe door, best shown by FIG. 15. The universal cam member 10 has an opposite side 40 which is typically mounted to face inwardly with respect to the safe, best shown in FIG. 14, and has an elevated or inwardly protruding sleeve 14 and protective skirt 50. The first side 20 is similarly provided with an extension of sleeve 14 having an outward surface which comprises a journal surface 32 which cooperates with a central aperture of a safe door. Passing through the sleeve 14 and universal cam member 10 is a centrally located aperture 12 through which a shaft or key associated with the lock mechanism may pass or be rotatably mounted. Sleeve 14 on side 40 is further provided on its radially outward surface with a pair of keyways 16 for cooperation with portions of an associated lock mechanism which may be assembled and mounted peripherally of the sleeve, within the protective skirt 50.

Figure 1:
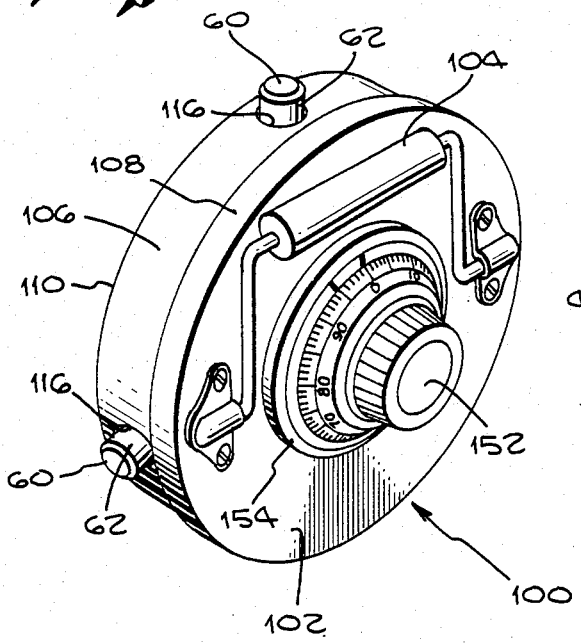
FIG. 1 is a perspective view of the outward facing side of a circular safe door provided with a combination lock and enclosing an embodiment of the universal boltworks mechanism of the present invention.
Figure 2:
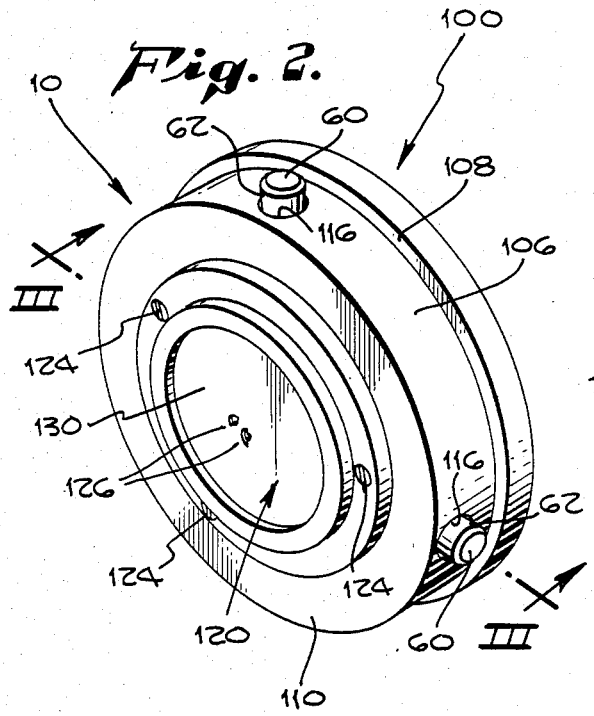
FIG. 2 is a perspective view of the inward facing side of the safe door of FIG. 1.

The circular-shaped safe door, shown in FIGS. 1 and 2 and generally indicated as 100, is an example of one of the shapes of safe door to which the universal boltworks mechanism of the present invention is intended to be compatable with. For this shape of safe door, it is well known in the art that the use of an odd-numbered plurality of bolts is the most effective way of securing and locking the circular-shaped door to its frame. An optimal number of such bolts is three, as is shown in FIGS. 1 and 2. A unique feature of a circular-shaped door is that it does not need to be moveably attached or mounted to its associated safe enclosure such as by hinges and thus is quite suitable for use for floor safes and the like since the circular shape is the only geometry of safe door that cannot fall into the safe interior when not inserted in proper alignment. Accordingly, for the preferred embodiment shown in FIGS. 1–13, safe door 100, as shown in FIG. 1, is provided with a handle 104 rather than a hinge mounting for lifting the door out of engagement with its door frame.

The safe door 100 is configured with an outwardly facing side 102 which in this embodiment is adapted for operation by a combination lock by the provision of a combination dial 152 and associated face plate 154 with indicator. The design of safe door shown in FIGS. 1 and 2 is particularly suited for maximum strength plus ease of manufacture in that the entire safe door 100 is fabricated from a single piece of high-strength material into which certain apertures are bored in order to receive the universal boltworks mechanism, lock mechanism, and bolts. More particularly, FIG. 2 shows the interior side 110 of the safe door 100 with a cover plate 120 mounted to it by three mounting screws 124 such that a universal boltworks mechanism contained therein is mounted in an assembled and operational condition. The outer edge 106 of the safe door, as is known in the art, is configured either cylindrically or with a slight inward sloping taper in order to sealably seat into a mating door frame of an associated safe enclosure. Additionally, an outward extending flange 108 is provided both as a stop to define the maximum seating depth of the safe door into the mating frame and as a protective shield preventing direct access to the multiple bolts 60 extending from the safe door into the safe door frame.

Figures 3, 4, 8, 9:
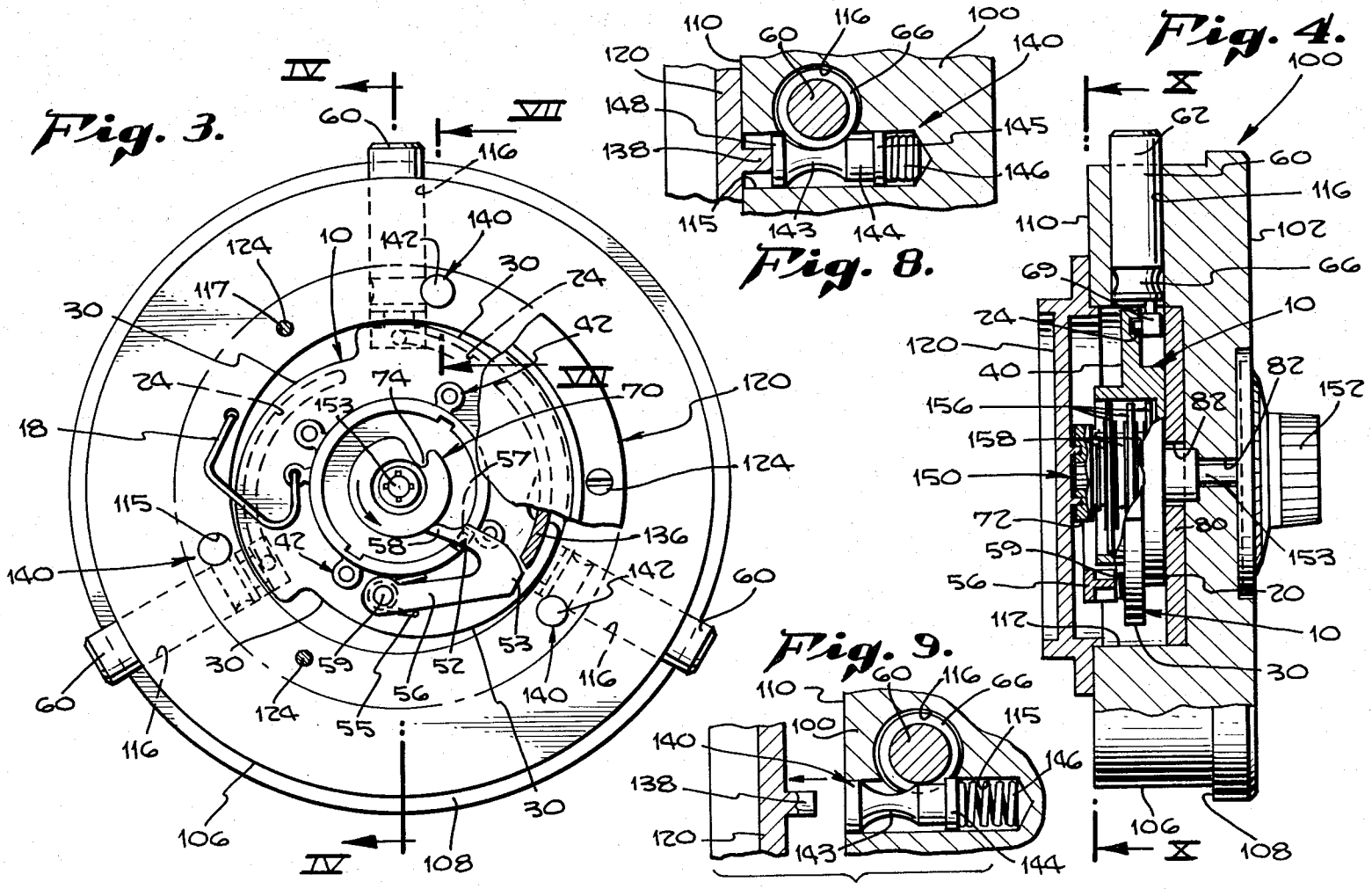
FIG. 3 is a partially cut-away front elevation of the universal boltworks mechanism of the present invention mounted in the safe door of FIG. 1 shown assembled in a first configuration and in a locked condition, the view taken in section along plane III—III of FIG. 2.
FIG. 4 is a partially cut-away side elevation of the universal boltworks mechanism of FIG. 3 taken in section along plane IV—IV of FIG. 3.
FIG. 8 is a top sectional view of the bolt inhibitor feature of FIG. 7 taken in section along plane VIII—VIII of FIG. 7.
FIG. 9 is a top sectional view similar to FIG. 8 and showing the bolt inhibitor feature of FIG. 7 in a bolt inhibiting condition.

As mentioned, the assembled safe door 100 of FIGS. 1 and 2 by virtue of its circular shape is provided with three equiangularly displaced door frame engaging bolts 60. These bolts 60 are formed of a high-strength material and have an elongated cylindrical shape. The bolts are slideably mounted within a respective radially extending bore or bolt channel 116 in the safe door such that the safe door frame engaging portion 62 of each of the bolts 60 may be extended radially outward of the outer surface 106 of the safe door into locking engagement with the safe door frame in response to operation of the universal boltworks mechanism contained within the safe door. FIGS. 1, 2 and 3 show the multiple bolts 60 in a radially outward or extended position such that the door frame engaging portion 62 of each of the bolts 60 would be engaged with apertures in the mating safe door frame, as may be seen in FIG. 7, and thus retain the safe door in a seated and locked condition.

FIG. 3 shows in detail the universal boltworks mechanism of the present invention, as adapted for use in the circular shaped door 100 of FIG. 1. As previously mentioned, a first and second assembly configuration is contemplated for linking the universal cam member 10 to the multiple door frame engaging bolts 60. While either of the two configurations may be used with a circular-shaped safe door and its optimal number of bolts 60, FIGS. 3–7 and 13 show the universal boltworks mechanism assembled in a first configuration wherein bolt-associated pins are engaged in and driven by inwardly spiraling grooves 24 which define a first bolt driving structure 22 as will be more fully described.

Referring primarily to FIGS. 3 and 4, safe door 100 is fabricated and adapted to receive the universal boltworks mechanism of the present invention by the following easy machining steps. First, a cylindrical disk is provided having an outer diameter corresponding with the maximum outer diameter of the resulting safe door 100. A portion of the periphery of the disk is machined to a smaller diameter in order to form the reduced diameter outer edge 106 and leaving the larger diameter peripheral flange 108. An access aperture 114 is drilled through the center of the cylindrical-shaped door. A cylindrical bore 112 is cut partially through the thickness of the cylindrical shaped door from its inward facing surface 110 in order to create a cavity in which the universal boltworks mechanism may be mounted. Three radially extending and equiangularly displaced bolt channels 116 are drilled from outer edge 106 into the cylindrical bore 112. Three inhibitor bores 115 are drilled partially through the thickness of the safe door from the inward facing surface 110, each in a location proximate and partially intersecting a respective bolt channel 116. Finally, multiple cover plate mounting apertures 117 are drilled in the inward facing surface 110 of the door 100 in order to receive screws 124 for mounting a cover plate 120. By the foregoing manufacturing steps which may be performed in any convenience sequence, a combined safe door and one embodiment of universal boltworks mechanism enclosure may be easily fabricated.

It can be seen in FIGS. 3 and 4 that the universal boltworks mechanism of the present invention is intended to be used in combination with, in this preferred embodiment, a combination lock 150 which comprises multiple tumbler wheels 156 and multiple interspaced spacers 158. The spacers are provided with tabs in their central aperture which operably engage the keyways 16 in sleeve 14 of the universal cam member 10, best seen in FIG. 14. Therefore, on rotation of the combination lock dial 152, as discussed hereinafter, the spacers 158 remain stationary about sleeve 14 with the tumbler wheels 156 being rotated to dial the predetermined combination. The assembly of the combination lock mechanism, the cooperation between the spacers 158 and the sleeve 14, as well as its operation is taught in a co-pending application for U.S. patent, Ser. No. 289,452 by Tim M. Uyeda entitled COMBINATION LOCK, assigned to the common assignee of this invention and incorporated herein by reference.

A lock mechanism which is compatible for use with the universal boltworks mechanism may include a standardized driving assembly for operably interconnecting the lock mechanism with the universal boltworks mechanism. The standardized driving assembly includes a lock engaging pawl 56 which is engagable with a lock mechanism driving cam 70. The lock mechanism driving cam 70 has a centrally located aperture having keyways adapted to receive driving shaft 153 which is attached to the combination lock dial 152. In this manner, rotation of the combination lock dial 152 causes rotation of the lock mechanism driving cam 70. By cooperation between the lock mechanism driving cam 70 and the multiple tumbler wheels 156 of the lock mechanism 150 in a manner taught by the above-mentioned co-pending patent application, a preselected and proper sequence of unlocking manipulations of the combination lock dial 152 will cause the gate portion of each of the multiple tumbler wheels 156 to become aligned both with themselves and with a follower engaging gate 74 in the cam surface 72 of the lock mechanism driving cam 70.

The driving assembly further includes a lock engaging pawl 56 which is rotatably mounted with respect to the universal cam member 10. Specifically, lock engaging pawl 56 is provided with mounting post aperture 59 and the universal cam member 10 is provided with a mounting post 54. First, a biasing spring 55 and then the lock engaging pawl 56 by its aperture 59 are pivotally mounted on mounting post 54 such that a cam follower portion 58 of the lock engaging pawl 56 may follow cam surface 72 and selectively be engaged by follower engaging gate 74. Lock engaging pawl 56 is further provided with a fence portion 57 which is located beneath the cam follower portion 58 in such manner that it may cooperate with the gate portions of each of the individual tumbler wheels 156 of the lock mechanism 150. Pawl 56 is also provided with a head portion 53 which is selectively engagable with pawl guiding ridge 136 of cover plate 120 in a manner which prevents rotation of the universal cam member 10 unless the pawl 56 is rotated inwardly with respect to driving cam 70. By this construction, it is contemplated that in response to the biasing of spring 55 the cam follower portion 58 of pawl 56 will follow cam surface 72 and will drop into engagement with follower engaging gate 74 when the gate portion of each of the multiple tumbler wheels 156 are each aligned to receive the fence portion 57 of lock engaging pawl 56, such alignment occuring only when a proper sequence of unlocking manipulations of the combination lock dial 152 have been performed. When such alignment occurs, pawl 56 pivots about mounting post 54 such that the head 53 moves radially inward such that it and thus the universal cam member 10 is no longer occluded against rotary motion in the direction of the arrow in FIG. 3 by the pawl guiding ridge 136 of cover plate 120 thereby allowing rotation of the entire universal cam member in response to a sequence of proper unlocking manipulations of the combination lock dial 152.

Figure 5:
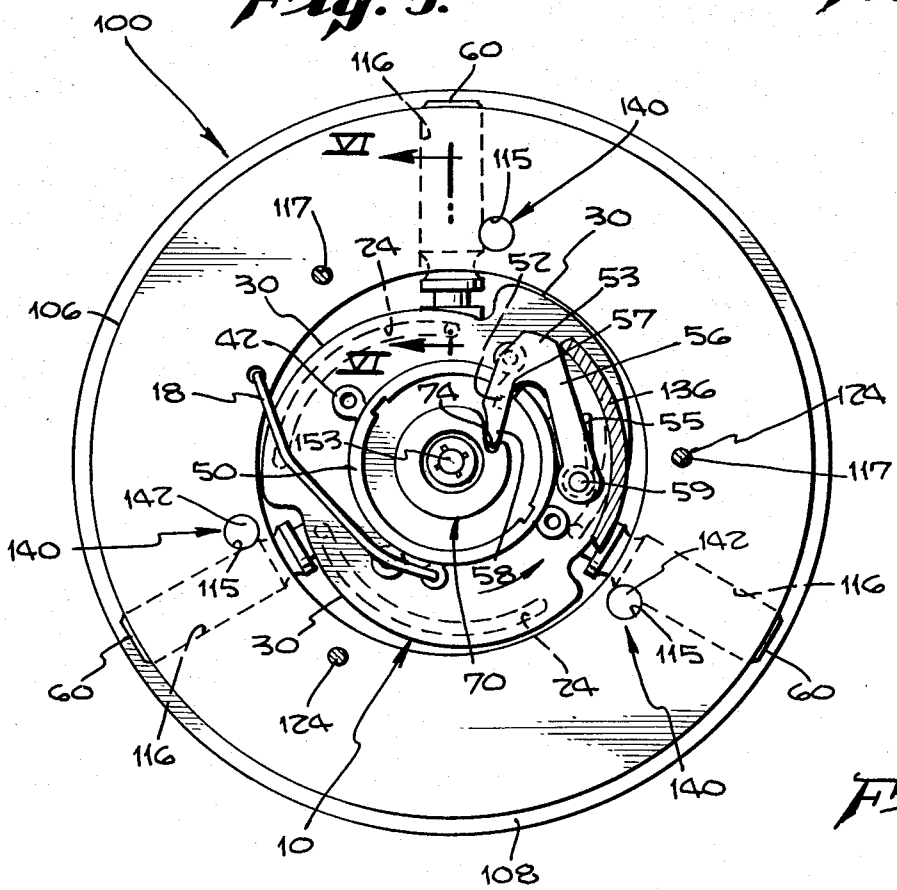
FIG. 5 is a partially cut-away front elevation similar to FIG. 3 of the universal boltworks mechanism of FIG. 3 shown in an unlocked condition, the view taken in section along plane III—III of FIG. 2.

By comparison of FIGS. 3 and 5, it can be seen that in response to the just-mentioned sequence of lock manipulations, the universal cam member 10 is rotated from the door-locked condition of FIG. 3 to the door-unlocked condition of FIG. 5. By the urging of overcenter spring 18, the universal cam member 10 is biased to assume one of these two alternative positions in preference over any intermediate position.

FIGS. 3–7 show the operation of the bolt driving structure 22 of the first configuration. This bolt driving structure 22 in this embodiment is comprised of multiple equiangularly displaced inwardly spiraling grooves 24 which are each provided with a radially inward end 28 and radially outward end 26. These spiraling grooves 24 are each adapted to cooperate with a door frame engaging bolt 60 by receiving a bolt-associated pin 68. In this embodiment, three inwardly spiraling grooves 24 of the first configuration are provided proximate the periphery of the universal cam member 10.

Each of the multiple door frame engaging bolts 60 has a door frame engaging portion 62, an inward portion 64, an inhibitor groove 66 and in this embodiment, a flat projection 69 with a driving pin 68. By this configuration, when a bolt 60 is positioned within a bolt channel 116 of the safe door 100 and the universal cam member 10 is properly assembled within the cylindrical bore 112 of the safe door, the driving pin 68 integral with a respective bolt 60 protrudes into the inwardly spiraling groove 24. By this cooperation, rotation of the universal cam member 10 in response to a proper unlocking manipulation of the lock mechanism 150 as previously described causes the bolt-associated pin 68 to track within the spiral groove 24 from the radially outward end 26 of the groove to the radially inward end 28 of the groove thereby causing each of the multiple bolts 60 to be translated or slid within its respective bolt channel 116 from a door frame engaging or locking position as shown in FIG. 3 to a disengaging or unlocked position as shown in FIG. 5 thereby permitting access to the contents of the safe. By operation of the overcenter spring 18, the universal bolt works mechanism would remain in the unlocked condition of FIG. 5 until such time as the safe door 100 is reseated into the safe door engaging frame and the combination dial 152 is subsequently rotated in a safe-locking direction, overcoming the biasing of the overcenter spring 18 and restoring the universal boltworks mechanism to the condition shown in FIG. 3 with each of the multiple bolts in a door frame engaged position as best seen in Figure.

More simply stated, in operation, a proper sequence of unlocking manipulations of the combination lock dial 152 causes the follower engaging gate 74 of lock mechanism driving cam 70 and the gates of the multiple tumbler wheels to be aligned to receive the cam follower portion 58 and pawl fence 57, respectively, of the pawl 56 allowing the lock engaging pawl 56 to rotate radially inward. A further rotation of the combination lock dial 152 causes the lock mechanism driving cam 70, lock engaging pawl 56, and universal cam member 10, the driving assembly, to rotate from the position seen in FIG. 3 to the position seen in FIG. 5 and thus, by operation of each of the inwardly spiraling grooves 24, the driving pins 68 of each of the door frame engaging bolts 60 are driven such that each of the bolts 60 is translated from a radially outward door frame engaging position to a radially inward door frame disengaged or unlocked position thereby unlocking the safe.

Figure 6:
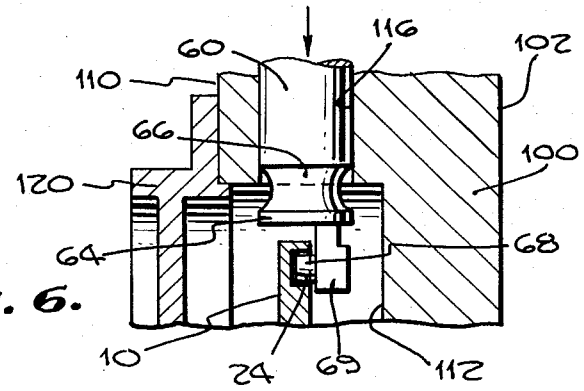
FIG. 6 is a side elevation of a portion of the universal boltworks mechanism of FIG. 3 taken in section along plane VI—VI of FIG. 5.

In accordance with one feature of the present invention, bolt inhibiting means or bolt inhibitors 140 are provided to inhibit motion of each of the bolts 60 from the door frame engaged or locked position shown in FIG. 3 to the door frame disengaged or unlocked position shown in FIG. 6 whenever a breakaway portion 130 of the cover plate 120 has been broken away in response to tampering forces in excess of a predetermined threshold being exerted on by the lock mechanism or universal boltworks mechanism. It is the function of the bolt inhibitors and cover plate breakaway portion to generally sense forces associated with improper tampering with the universal boltworks mechanism and to cause disabling disassembly which renders the universal boltworks mechanism inoperative in the safe-locked condition thereby frustrating the theft attempt.

A cover plate 120 is provided for maintaining the universal boltworks mechanism in an assembled condition and enclosing it within the cylindrical bore 112 of the circular shaped door 100. To this purpose, the cover plate 120 is provided with multiple mounting apertures 122 which receive mounting screws 124 for fastening the cover plate 120 to the inward facing surface 110 of the safe door. The cover plate 120 may be provided with lock resetting keyways 126 for resetting the combination of the combination lock 150 in a manner which is known in the art. In addition, the cover plate 120 is provided with a ring-shaped journal ridge 134 which cooperates with a mating groove of the driving cam member 70 to permit rotation of the cam member relative to the cover plate and to maintain the cam member 70, the lock mechanism 150 and universal boltworks mechanism in an assembled condition.

In accordance with the bolt inhibitor feature of the present invention, the cover plate 120 is further provided with strength reducing grooves 132 which extend adjacent to each of the mounting apertures 122 such so that a substantial portion of the cover plate 120 is isolated from the mounting apertures 122 by these strength reducing grooves 132 to form a breakaway portion 130 which comprises a substantial portion of the cover plate 120. The cover plate 120 is further provided with inhibitor detents 138 which cooperate with the multiple bolt inhibitors 140 to inhibit motion of each of the bolts in a manner which will be more fully described. By this construction, any drilling, hammering or other forces in excess of a predetermined threshold which are exerted on the combination lock shaft 153, a universal boltworks mechanism associated barrier plate 80, the universal cam member 10, or the like will be transmitted by the universal boltworks mechanism through driving cam 70 and ring-shaped journal ridge 134 to the breakaway portion 130 of cover plate 120 causing that portion of the cover plate to be broken and separated away at the strength reducing grooves 132 such that a substantial portion of the cover plate falls away from the inward facing surface 110 of the safe door thereby no longer retaining the universal boltworks mechanism in an assembled and operational condition. This falling away of the breakaway portion 130 of the cover plate 120 also operates to move the inhibitor detents 138 out of proximity or engagement with the bolt inhibitors 140 causing the bolt inhibitors to inhibit motion of the locking bolt.

Figure 7:
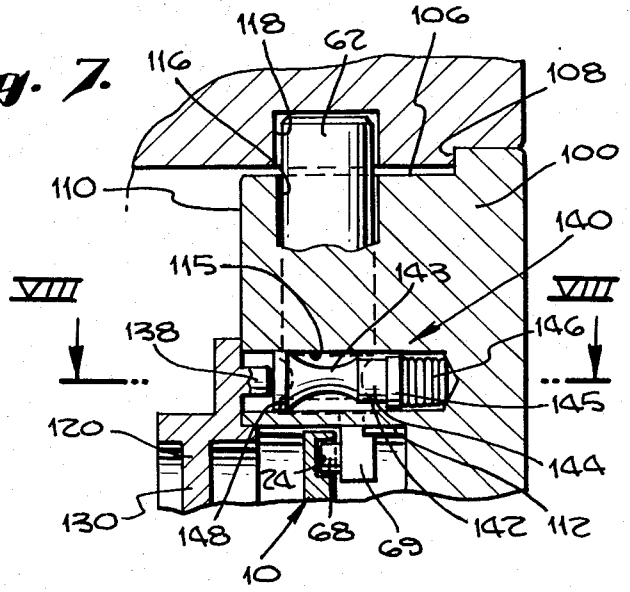
FIG. 7 is a partially cut-away side elevation of a portion of the universal boltworks mechanism of FIG. 3 taken in section along plane VII—VII of FIG. 3 and showing one embodiment of the bolt inhibitor feature of the present invention in a normal operating condition.

The bolt inhibitors 140 of this embodiment are best seen in FIGS. 7–9. FIGS. 7 and 8 show two views of the bolt inhibitor 140 in a normal operating condition as occurs when the cover plate 120 is properly seated and mounted to the interior facing surface 110 of the safe door 100. Each of the bolt inhibitors 140 is located proximate a respective door frame engaging bolt 60 mounted within a bolt inhibitor aperture 115 of the safe door. Each of the bolt inhibitors 140 comprises an inhibiting member 142 which is provided with a reduced diameter groove portion 143, a cylindrical shaft portion 144, a flange portion 145 and a top surface 148. When in the normal operating condition, the inhibitor detent 138 of cover plate 120 engages the top surface 148 of the inhibiting member 142 which overcomes the biasing of a coil spring 146 and depresses the inhibiting member 142 into its respective inhibitor bore 115 of the safe door. When in this depressed condition, as best seen in FIG. 8, a reduced diameter grooved portion 143 becomes aligned with the respective bolt channel 116 to permit a bolt 60 to freely slide radially inward and outward relative to the inhibitor.

Each of the door frame engaging bolts 60 is provided with a reduced cross-sectional inhibitor groove 66 which, when the bolt is in the door-locked position, is in alignment with its respective inhibitor bore 115 permitting inward and outward motion of the inhibiting member 142. It can be seen in FIGS. 8 and 9 that when the inhibitor detent 138 is removed from proximity with the top surface 148 of its respective inhibiting member 142 as during the breaking away of the breakaway portion 130 of the cover plate 120, in response to the biasing of the coil spring 146 the cylindrical shaft portion 144 of the inhibiting member 142 translates into engagement with the inhibiting groove 66 of the respective bolt 60 which occludes the bolt channel inhibiting any further sliding motion of the bolt 60 thereby preventing the safe from being unlocked thereby frustrating a theft attempt. Flange portion 145 of the inhibiting member 142 operates to prevent the member from falling out of the inhibitor bore 115 in response to the spring 146 thereby retaining the inhibiting member 142 in occlusive engagement with the inhibitor groove 66 of the bolt 60.

Figure 13:
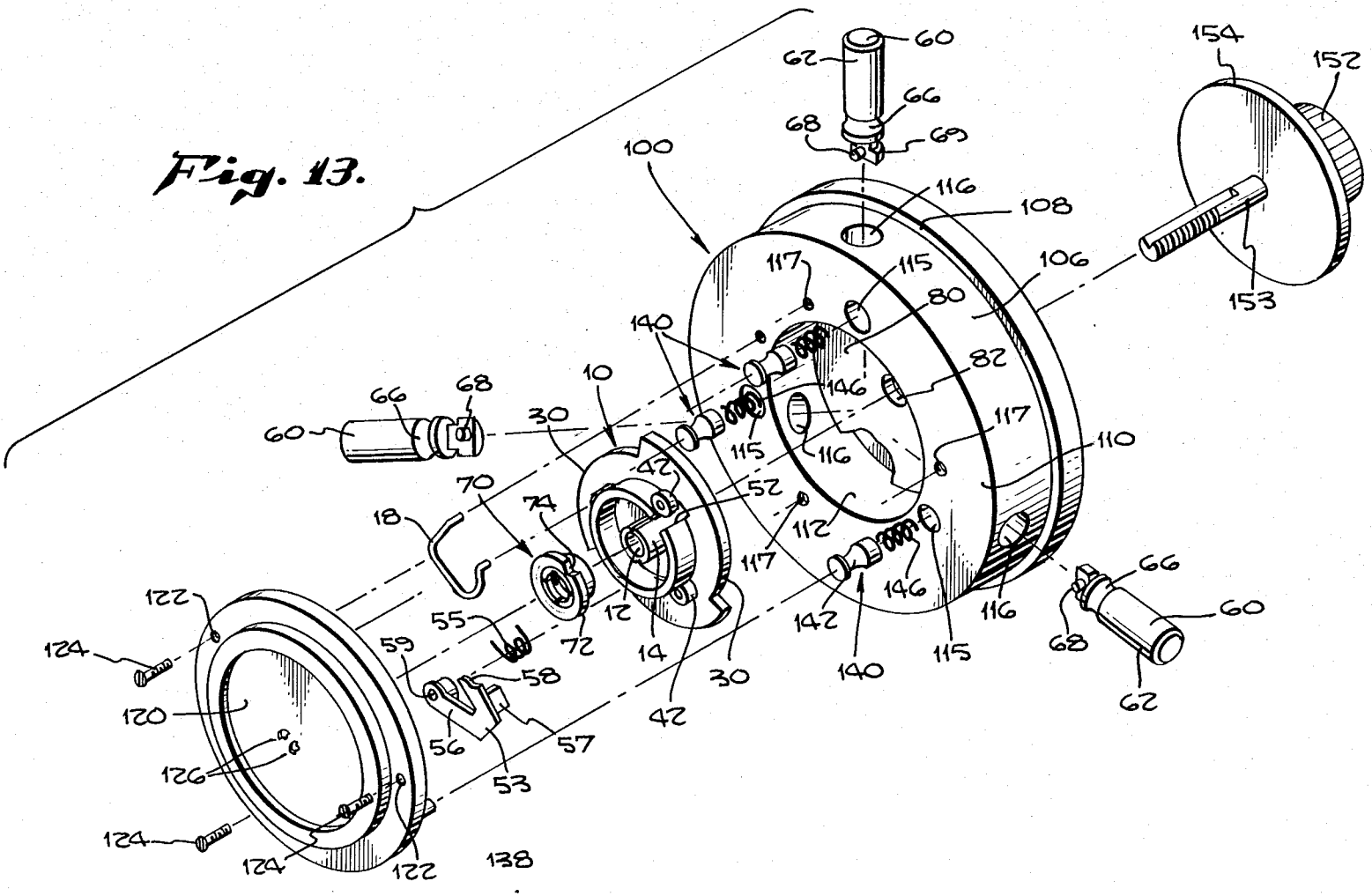
FIG. 13 is an exploded assembly drawing of the safe door of FIG. 1 including the universal boltworks mechanism of FIG. 3.

Referring to FIG. 13, it can be seen that this embodiment of the universal boltworks mechanism is adapted for easy assembly without requiring the skills of a professional boltworks. In order to assemble the universal boltworks mechanism in a circular-shaped safe door in accordance with this first bolt driving configuration, a circular-shaped door 100, machined or manufactured as previously described, is provided. For additional lock mechanism protection, an optional high-strength barrier plate 80 having a central aperture 82 may be positioned at the bottom of the cylindrical bore 112. The combination lock dial 152, face plate 154, and driving shaft 153 may be inserted through the access aperture 114 of the safe door such that the driving shaft 153 extends into the cylindrical bore 112. Each of the three bolt assemblies may be assembled by dropping the bolt inhibitor coil spring 146 and the inhibiting member 142 into a respective inhibitor bore 115 of the safe door. While the inhibiting member 142 is depressed into the inhibitor bore 115 overcoming the biasing of coil spring 146, a door frame engaging bolt 60 which has been selected or cut to a size corresponding with the diameter of the safe door is inserted into its respective bolt channel 116 and rotated such that its respective driving pin 68 is oriented upward. Once the bolt 60 has been inserted into bolt channel 116, its respective inhibiting member 142 may be released. Once all three bolts are positioned, the universal cam member may be dropped onto the combination lock driving shaft 153 and into the cylindrical bore 112 and then rotated slightly until each of the driving pins 68 of the three bolts 60 is engaged in its respective bolt driving structure 22, namely inwardly spiraling groove 24. The remainder of the combination lock mechanism may then be placed on the combination lock driving shaft 153 and sleeve 14 of the universal cam member 10 in a manner disclosed in the previously-mentioned co-pending U.S. patent application. Assembly of the lock mechanism may be completed by the positioning of the lock mechanism driving cam 70 onto the end of the driving shaft 153. Assembly of the driving assembly is completed by dropping biasing spring 55 and then pawl 56 onto the mounting post 54 of the universal cam member 10. The overcenter spring 18 may be mounted to the universal cam member 10 and the safe door 100 and the entire assembly may then be enclosed and made operational by the positioning of cover plate 120 so that each of the inhibitor detents 138 protrudes into a respective inhibitor bore 115, and inserting multiple mounting screws 124 to pass through mounting apertures 122 of the cover plate 120 and into respective mounting apertures 117 in the safe door 100.

The square-shaped safe door shown in FIGS. 16 and 17 and generally indicated as 200, provides an example of another shape of safe door to which the universal boltworks mechanism of the present invention is intended to be compatible with. For rectangular-shaped doors in general, it is well known in the art that the use of an even-numbered plurality of door locking bolts is the most effective way of securing and locking a safe door having an even number of sides to its frame. For the particular instance, as is shown, wherein the rectangular-shaped door intended for use with the universal boltworks mechanism is square, the optimal number of bolts for use with this door is four, as is shown in FIGS. 16 and 17. Typically, square-shaped safe doors such as the one shown, are mounted to the safe enclosure by hinges which assist in the coordinated movement of the door into and out of seating relationship with its mating door frame. Where it is contemplated that the hinge has a high-strength construction that it may serve as the equivalent of a locking bolt, one or two of the four bolts shown in FIGS. 16 and 17 may be eliminated from the construction thereby reducing the cost of the universal boltworks mechanism but not requiring any change in design. If only two bolts were to be used, the lock mechanism and universal boltworks mechanism could be mounted proximate the edge of the safe door distal from the hinges such that the two remaining bolts extend oppositely and laterally relative to the hinge in order to lock the door. The reminder of this discussion, however, will concern the preferred embodiment of four equiangularly displaced door frame engaging bolts mounted to a square safe door 200.

The safe door 200 in this alternative construction is adapted for use with a pre-assembled universal boltworks mechanism which is simply attached to the interior surface of the safe door thereby reducing fabrication cost of the door. While it is specifically contemplated that a square-shaped door may also be bored in the same manner of fabrication as was described for the circular-shaped safe door shown in FIGS. 1 and 2 in order to assemble a universal boltworks mechanism within a centrally located interior bore, this alternative construction, while not limited in application by the shape of the door to which it is shown attached, is disclosed as an alternative means of providing an easily assembled universal boltworks mechanism.

As in shown in FIGS. 16 and 17, it is contemplated that the universal boltworks mechanism may also be used with a key and keyway type of lock mechanism 260 which includes an externally accessable keyway 264 which is manipulable and unlocked by a key 262. The access to keyway 264 is provided through a centrally located access aperture 214 which extends through the outward facing surface 202 of the square shaped door shown in FIG. 16. The safe door 200 also has an inward facing surface 210 seen in FIG. 17 to which is mounted the universal boltworks mechanism. In this embodiment, the mechanism is contained within a mounting enclosure or pan 280. The inward surface 210 of the square shaped safe door 200 is further provided with an outer end 206 which sealably mates with a respective door frame. A peripheral flange 208 positioned at one portion of outer edge 206 is provided both as a stop to define the maximum seating depth of the safe door into the mating frame and as a protective shield presenting direct access to the multiple bolts 60 extending from the safe door into the safe door frame.

As mentioned, the assembled safe door and universal boltworks mechanism in FIGS. 16 and 17 is provided with four equiangularly displaced door frame engaging bolts having a construction similar to the bolts used in the circular-shaped safe door 100. These bolts 60 are formed of a high strength material, have an elongated cylindrical shape, and are slidably mounted within a respective bolt channel which is formed from bolt receiving apertures 284 in a manner which will be more fully described. It is contemplated that these multiple bolts 60 may slide in unison between an outward or frame-engaging or locking postion as seen in FIGS. 16–19 & 21 and an inward, retracted or disengaged position shown in FIG. 20.

Figure 18:
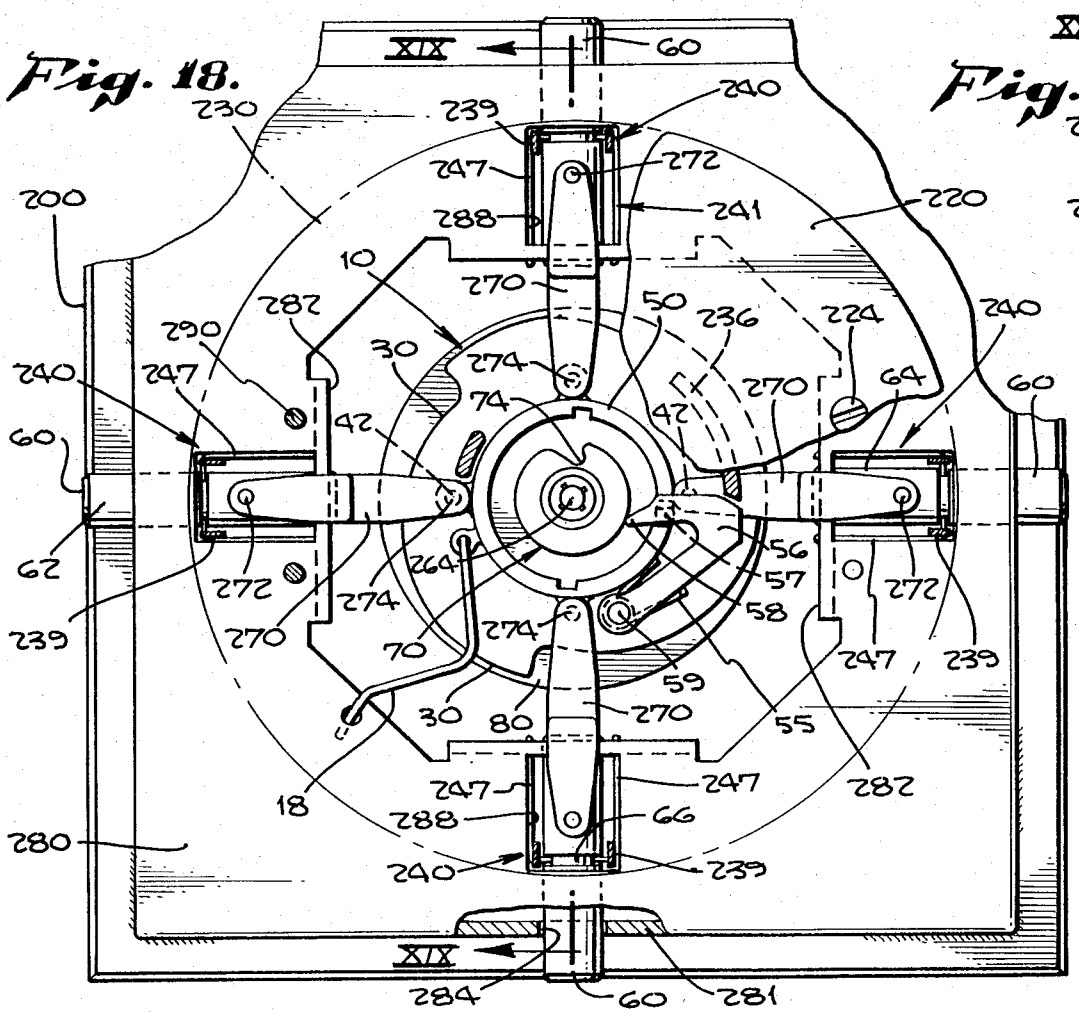
FIG. 18 is a partially cut-away front elevation of the universal boltworks mechanism of the present invention mounted to the safe door of FIG. 16 shown assembled in a second configuration and in a locked condition, the view taken in section along plane XVIII—XVIII of FIG. 17.

FIG. 18 shows in detail the universal boltworks mechanism of the present invention similar to that shown in combination with a circular-shaped door but adapted for use in the square-shaped door 200 of FIG. 16. As previously mentioned, a first and second assembly configuration is contemplated for linking the universal cam member 10 to the multiple door frame engaging bolts 60. Having already described the first assembly configuration, the second assembly configuration is shown in the context of a square shaped safe door even though its application is not limited to that shape of safe door. The application of this configuration is dictated by the number of bolt driving structures in accordance with the second configuration 42 which are provided on the universal cam member thereby dictating the number of bolts 60 which may be driven and therefore the optimum shape to which that number of bolt driving structures may be constructed in combination with.

Briefly, the second configuration of bolt driving structure 42 comprises the provision of multiple bosses 44 on the universal cam member 10 each having an aperture 46 which may receive a bolt driving linkage-associated pin. The bolt driving linkage 270 is provided with a bolt engaging pin 272 which drops into a linkage aperature 67 of a respective bolt 60 and a driving structure engaging pin 274 which drops into the aperture 46 of boss 44 to thereby link each of the door frame engaging bolts 60 to the universal cam member 10 and thereby drive the bolts inwardly and outwardly in response to rotation of the universal cam member.

Referring particularly to FIGS. 17–21 & 27, an alternative embodiment of universal boltworks mechanism enclosure is shown which may be easily fabricated and adapted to receive the universal boltworks mechanism of this second configuration by the following easy manufacturing steps. First, a sheet of suitable enclosure material is provided, such as sheet steel, for forming into the enclosure or pan 280 used for mounting the universal boltworks mechanism. The sheet of enclosure material may be die-cut or stamped into a particular configuration as may be best determined from FIG. 27 whereby in the stamping process multiple bolt guide portions 282, bolt receiving apertures 284, inhibitor mounting apertures 286, rectangular cutouts 288, and cover mounting apertures 290 may be cut into the sheet of material. Then, the sheet of material may be folded to form a box with bolt guides by folding up four side portions 281 and four bolt guide portions 282. By the foregoing manufacturing steps, a universal boltworks mechanism enclosure may be easily fabricated.

Figure 21:
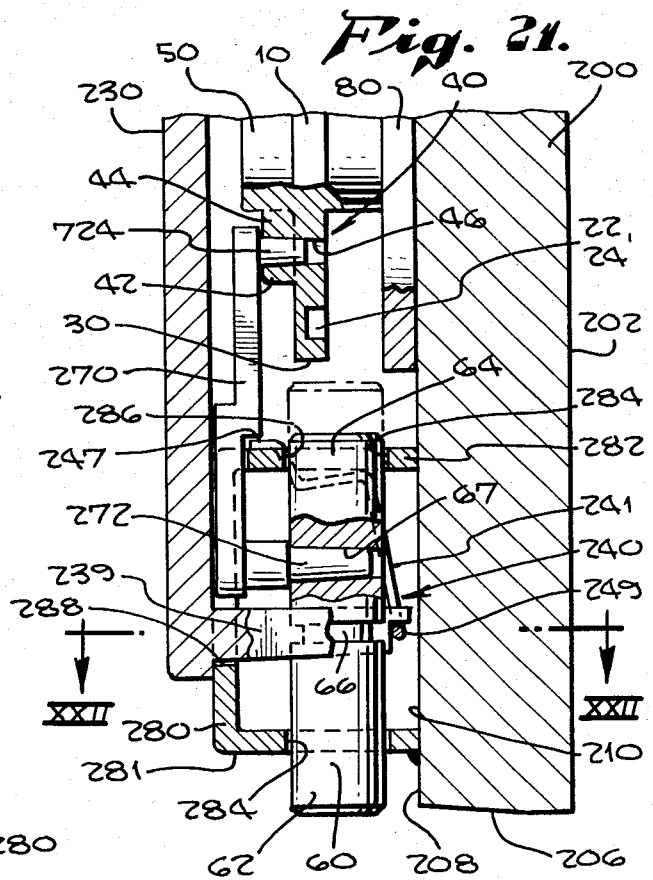
FIG. 21 is an enlarged partially cut-away side elevation of a portion of the universal boltworks mechanism of FIG. 18 similar to the view of FIG. 19 including an alternative embodiment of the bolt inhibitor feature of the present invention in a normal condition, the view taken in section along plane XIX—XIX of FIG. 18.

Once the universal boltworks mechanism has been assembled in this mounting enclosure or pan 280, the entire pan may be simply welded to the interior surface 210 of safe door 200 by multiple welds 292 shown in FIG. 21, thereby making the pan an integral portion of the safe door.

Figure 19:
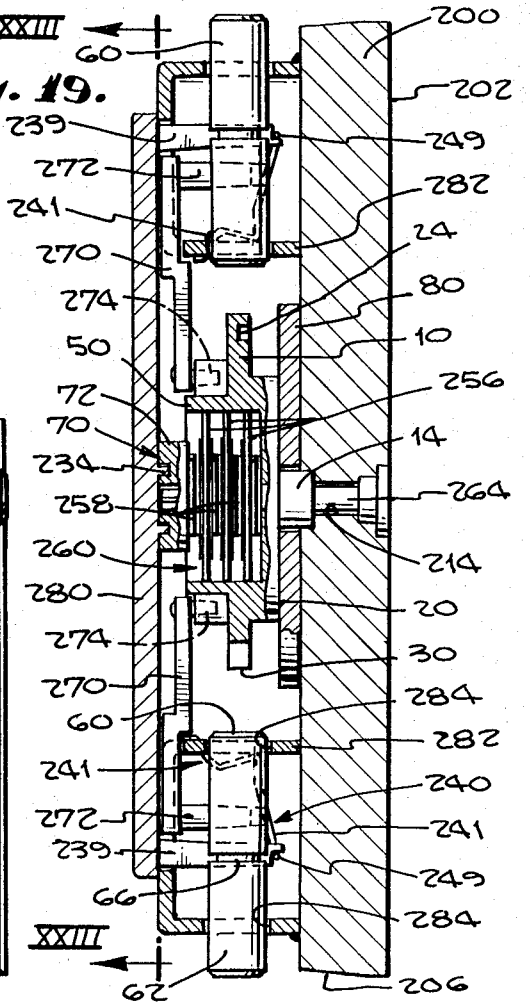
FIG. 19 is a partially cut-away side elevation of the universal boltworks mechanism of FIG. 18 taken in section along plane XIX—XIX of FIG. 18.
Figure 20:
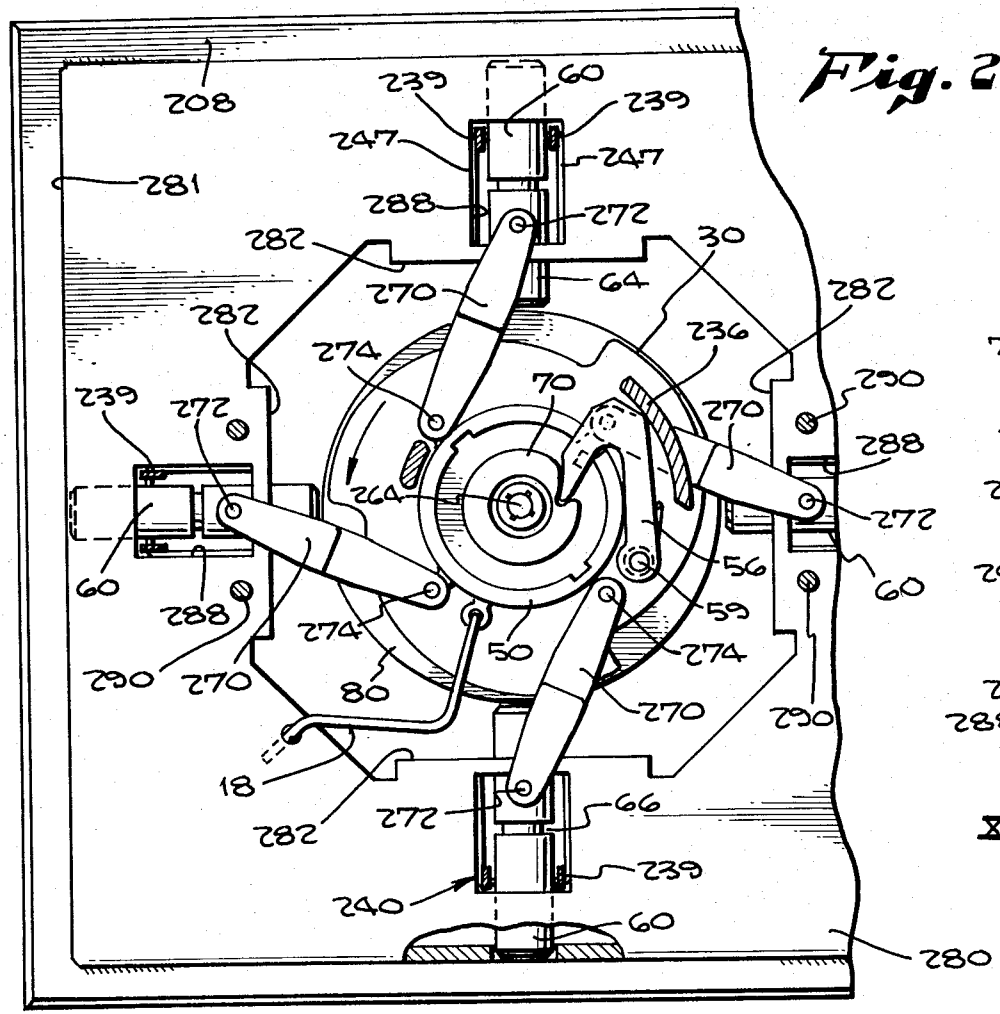
FIG. 20 is a partially cut-away front elevation similar to FIG. 18 of the universal boltworks mechanism of FIG. 18 shown in an unlocked condition, the view taken in section along plane XVIII—XVIII of FIG. 17.
Figure 25:
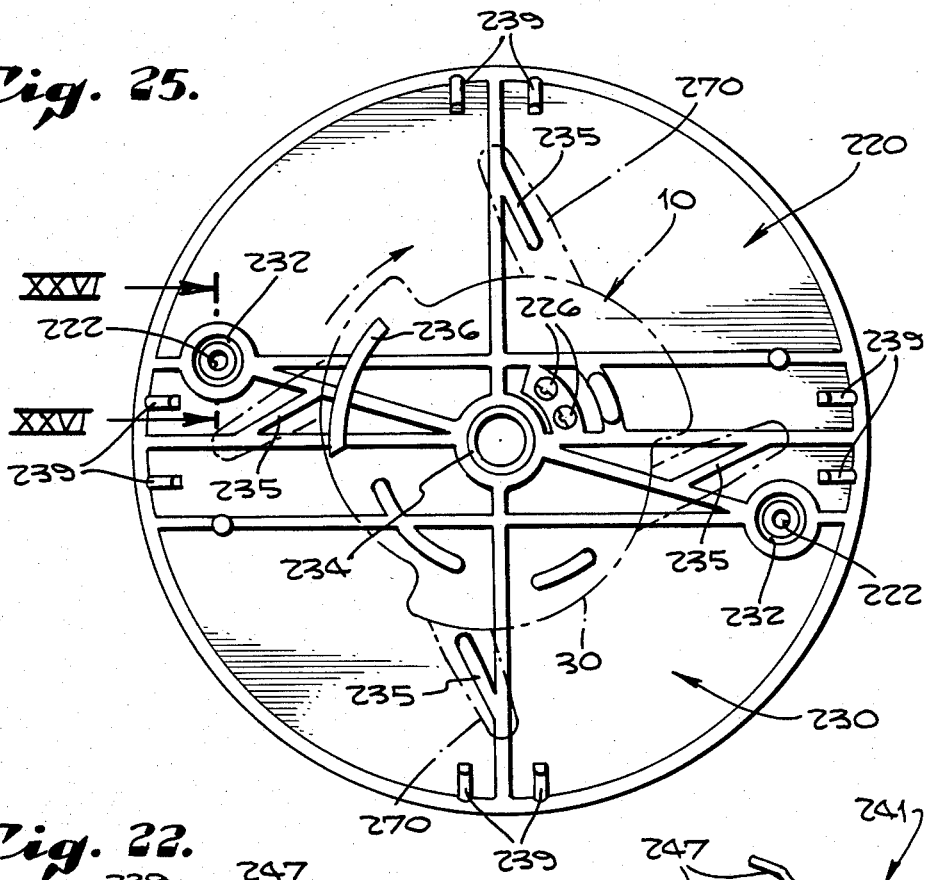
FIG. 25 is a front view of the cover plate portion of the universal boltworks mechanism of FIG. 18.

It can be seen in FIGS. 18 and 19 that the universal boltworks mechanism of the present invention is configured to be used in combination with, in this preferred embodiment, a key operated lock mechanism 260 which comprises multiple key actuated tumbler wheels 266 which are asembled in a manner known in the art. As with the combination lock assembly, the multiple tumbler wheels 266 of the key operated lock are each provided with a gate portion which is adapted to receive a fence portion 57 of a lock engaging pawl 56 mounted to the universal cam member 10 as in the previous embodiment. Thus, for the key lock mechanism 260, a lock mechanism driving cam 70 is provided, which in this configuration is rotatable in response to manipulation of a key 262. Insertion and rotation of the proper key 262 causes the follower engaging gate 74 of the driving cam 70 and each of the gates of the multiple tumbler wheels 266 to be aligned permitting the cam follower portion 58 of the lock engaging pawl 56 to engage and be rotated by the follower engaging gate 74 in response to further rotation of key 262. By this manipulation, the universal cam member 10 is rotatated from a door-locked position as best shown in FIG. 18 to a door-unlocked position as best shown in FIG. 20. Again, it can be seen by one skilled in the art, that a standardized driving assembly consisting of a lock mechanism driving cam member 70 and lock engaging pawl 56 may be utilized in combination with the universal cam member 10 to permit driving of the universal boltworks mechanism by any of a variety of configurations of lock mechanisms.

By comparison of FIGS. 18 and 20, it can be seen that in response to the just-mentioned sequence of lock manipulations, that the universal cam member 10 is rotated from the door-locked condition of FIG. 18 to the door-unlocked condition of FIG. 20. By the urging of over center spring 18, the universal cam member is again biased to assume either one of these two alternative positions in preference over any intermediate position.

FIGS. 18–21 show in detail the bolt driving structure 42 of the second configuration. Referring briefly to FIG. 14, the universal cam member 10 is provided with these bolt driving structures 42 in the form of raised bosses 44 which are proximate the periphery of the universal cam member and adjacent an outer edge of protective skirt 50 into which the lock mechanism is assembled. Each of these raised bosses 44 is provided with a centrally located aperture having an axis which is parallel to the axis of the central aperture 12 of the universal cam member.

In order to be compatible with this second configuration, each of the multiple door frame engaging bolts 60 again has an elongated cylindrical shape but is additionally provided with a linkage aperture 67 extending partially through a diameter of the bolt for receiving a linkage pin whereby the bolt may be slid outwardly and inwardly with respect to the door in response to driving forces parted by the linkage pin to linkage aperture 67.

In this configuration, each bolt 60 is slidably mounted within bolt receiving apertures 284 which are found in a respective side portion 281 and respective bolt guide portion 282 of the mounting enclosure 280. These two bolt receiving apertures 284 operate as a channel to control the translation of the bolt 60 mounted thereby such that the bolt may move only outwardly into engagement with a mating door frame or inwardly out of locking engagement with that door frame.

As may be best seen in FIGS. 18–20, a bolt driving linkage 270 is provided having at one end a bolt engaging pin 272 and at the other end a driving structure engaging pin 274. This second configuration of bolt driving assembly is assembled by positioning a respective bolt 60 within the bolt channel formed by the bolt receiving apertures 284, positioning a universal cam member 10 centrally within the mounting enclosure 280 and dropping bolt driving linkage 270 such that the bolt engaging pin 272 drops through the rectangular cutout 288 of the enclosure 280 into the linkage aperture 67 of the respective bolt 60. The driving structure engaging pin 274 drops into the aperture 46 of the respective bolt driving structure 42. By this linkage, it can be seen that rotation of the universal cam member 10, by the operation of each of the four bolt driving linkages 270, translates into inward and outward sliding motion of the multiple bolts 60 in unison. By operation of the overcenter spring 18, the universal boltworks mechanism remains in the locked condition of FIG. 18 until such time as a proper manipulation of the lock mechanism, in this case the insertion and rotation of a proper key 262 into key way 264, causes the lock engaging pawl 56 to be rotated such that its head portion 53 is moved out of occluding relationship with the pawl guiding ridge 236 of cover plate 220 permitting rotation of the universal cam member 10 to the door-unlocked position of FIG. 20 whereby each of the multiple bolts 60 is retracted to a door frame disengaged or unlocked position.

In accordance with another feature of the present invention, an alternative embodiment of bolt inhibitor 240, particularly configured for use with the mounting enclosure or square pan 280, is provided to inhibit motion of each of the bolts 60 from the door frame engaged or locked position shown in FIG. 18 to the door frame disengaged or unlocked position shown in FIG. 20 whenever a breakaway portion 230 of the cover plate 220 has been broken away. This breaking away again occuring in response to tampering forces in excess of a predetermined threshold which are exerted on the lock mechanism or universal boltworks mechanism. Similar to the previously described embodiment, it is the function of the bolt inhibitors and the cover plate breakaway portion to generally sense forces associated with improper tampering of the universal boltworks mechanism and to cause disabling disassembly which renders the universal boltworks mechanism inoperative in the safe-locked condition, thereby frustrating the theft attempt.

In accordance with this alternative embodiment of the bolt inhibitor feature, a cover plate 220 is provided for maintaining the universal boltworks mechanism in an assembled condition and enclosing it within the mounting enclosure 280 for attachment to a square-shaped door 200. The cover plate 220 is provided with multiple mounting apertures 222 which receive mounting screws 224 for fastening the cover plate 220 to the cover mounting apertures 290 of the mounting enclosure 280. The cover plate 220 may be provided with lock resetting keyways 226 for resetting the combination of the lock contained therein in any manner which is known to the art. The cover plate 220 is also provided with a ring-shaped journal ridge 134 which cooperates with a mating groove of the lock mechanism driving cam 70 to permit rotation of the cam member relative to the cover plate while maintaining cam member 70, the lock mechanism 260, and the universal boltworks mechanism in an assembled condition.

Further in accordance with this alternative bolt inhibitor feature, the cover plate 220 is provided with strength reducing grooves 232 to isolate and thus form a breakaway portion 230 comprising a substantial portion of the cover plate 220. The breakaway portion 230 of the cover plate 220 is further provided with multiple inhibitor spring displacing arms 239 which cooperate with the multiple bolt inhibitors 240 to inhibit motion of each of the bolts in a manner which will be more fully described. By this construction, any tampering forces in excess of the predetermined threshold which are transmitted to the cover plate 220 by the universal boltworks mechanism assembly through driving cam 70 causes the cover plate to be broken and separated away at the strength reducing grooves 232 such that a substantial portion of the cover plate falls away from the inward facing surface 110 of the safe door thereby no longer retaining the universal boltworks mechanism in an assembled and operational condition. This falling away of the breakaway portion 230 of the cover plate 220 also operates to move each of the inhibitor spring displacing arms 239 out of proximity or engagement with a respective bolt inhibitor 240 causing the bolt inhibitor to inhibit motion of the locking bolt.

Figure 22:
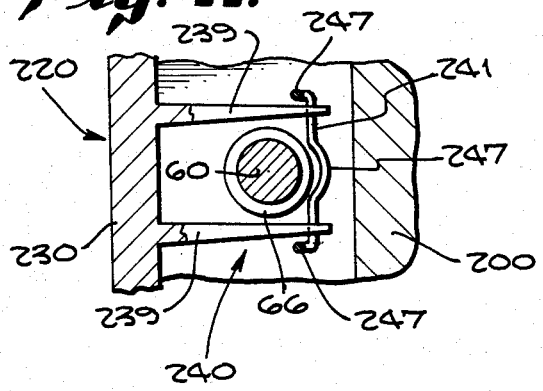
FIG. 22 is an enlarged top sectional view of the bolt inhibitor feature of FIG. 21 taken in section along plane XXII—XXII of FIG. 21.
Figure 23:
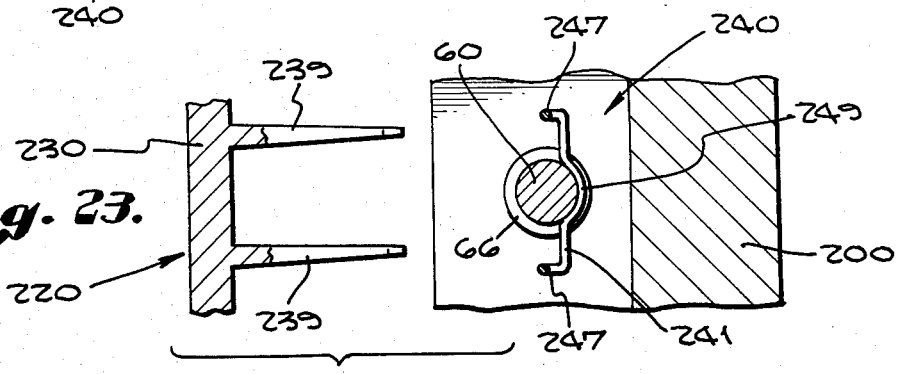
FIG. 23 is an enlarged top sectional view similar to FIG. 22 and showing the bolt inhibitor feature of FIG. 21 in a bolt inhibiting condition, the view taken in section along plane XXII—XXII of FIG. 21.

The bolt inhibitors 240 of this embodiment are best seen in FIGS. 20–24. FIG. 22 shows the bolt inhibitor 240 in a normal operating condition as occurs when the cover plate 220 is properly seated and mounted to the mounting enclosure 280. FIG. 23 shows the bolt inhibitor 240 in a bolt inhibiting condition.

Figure 24:
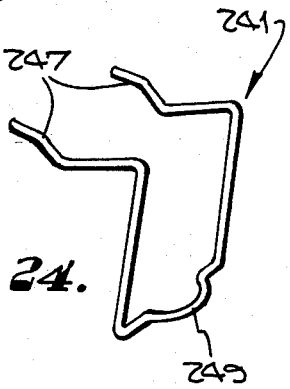
FIG. 24 is a perspective view of the bolt inhibitor spring used in the alternative embodiment of the bolt inhibiting feature of FIG. 21.

Each of the bolt inhibitors 240 is positioned proximite a respective door frame engaging bolt 60 and, in this embodiment, comprises a bolt inhibiting spring member 241 best shown in FIG. 24. The bolt inhibiting spring member 241 has a centrally located bolt engaging portion 249 having a shape adapted to occlusively engage the inhibitor groove 66 of the respective bolt 60 thereby inhibiting its motion. Each of the bolt inhibiting spring members 241 is further provided with a pair of mounting arm portions 247 which may be inserted into inhibitor mounting apertures 286 located on the bolt guide portion 282 of the mounting enclosure 280 such that the bolt engaging portion 249 of the bolt inhibitor 240 is continuously biased in a direction such so that the bolt engaging portion 249 would drop into, be seated within, and occlude the inhibitor grooves 66 of the respective bolts 60 whereby inhibiting the bolt from further inward and outward motion from the safe door locked position. It may be seen in FIGS. 22 and 23 that when properly assembled, the inhibitor spring displacing arms 239 of cover plate 220 engages either side of the bolt engaging portion 239 of the bolt inhibiting spring member 241, lifting the bolt engaging portion out of engagement with the respective bolt 60 permitting motion of the bolt as during normal operation. The breaking away of breakaway portion 230 of cover plate 220, as occurs during tampering or attempted theft of the safe contents, removes the inhibitor spring displacing arms 239 of the breakaway portion 230 from displacing proximity with the bolt engaging portion 249 of the bolt inhibiting spring member 241 causing the spring member to assume the bolt inhibiting position of FIG. 23.

Figures 26, 27:
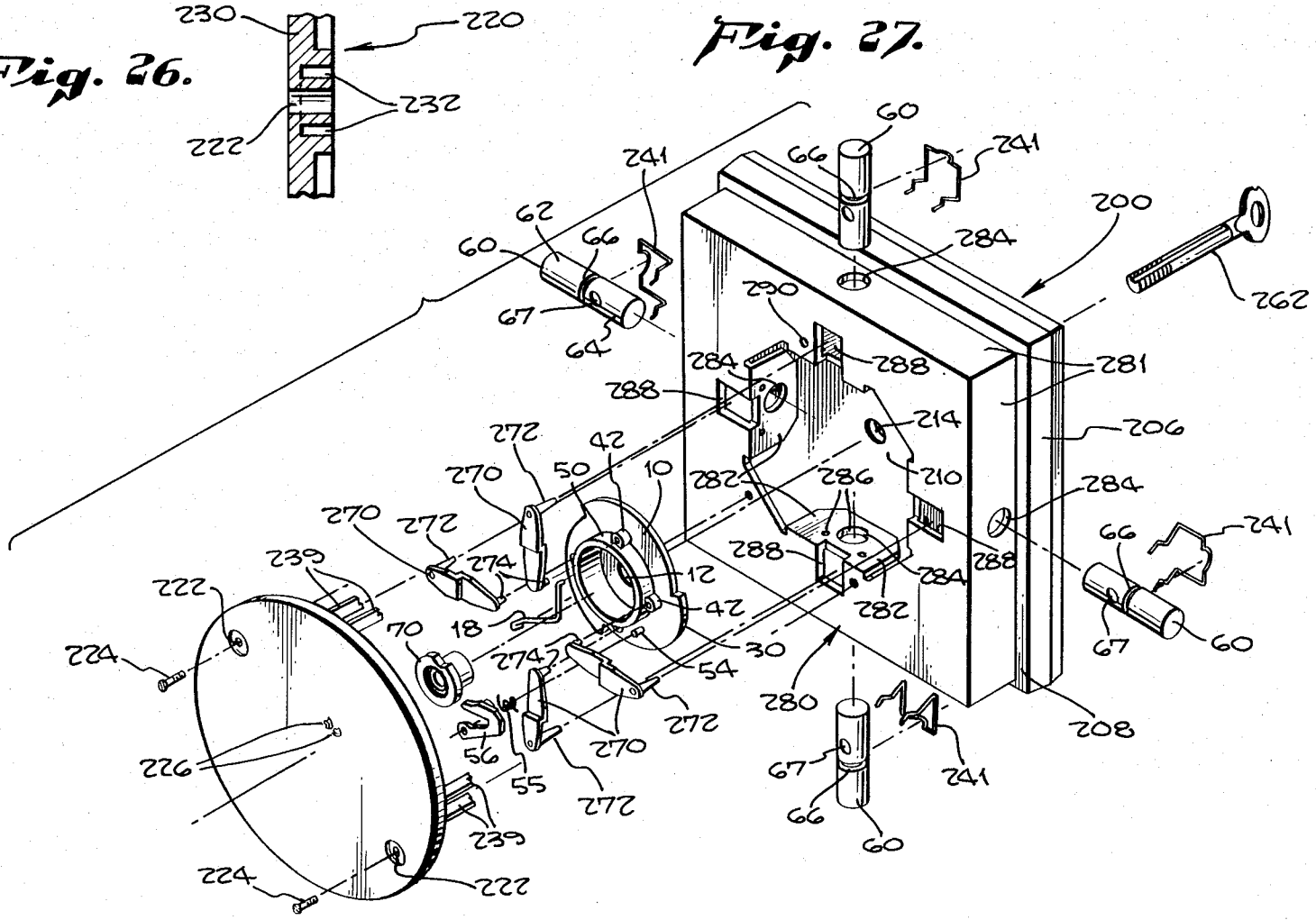
FIG. 26 is an enlarged side view in section of a portion of the cover plate of FIG. 25 taken in section along plane XXVI—XXVI of FIG. 25.
FIG. 27 is an exploded assembly drawing of the safe door of FIG. 16 including the universal boltworks mechanism of FIG. 18.

FIG. 26 shows in detail the strength reducing grooves 232 of cover plate 220 which are used to cause a breakaway portion 230 of the cover plate to be easily broken away in response to tampering forces.

FIG. 27 shows that this embodiment of the universal boltworks mechanism is equally adapted for easy assembly without requiring the skills of a professional boltworks. It is particularly contemplated that by use of the mounting enclosure or square pan 280, that the lock mechanism and boltworks mechanism is provided to a blacksmith in a preassembled condition such that the mounting enclosure 280 merely needs to be welded to the interior side 210 of a square shaped safe door 200 such that the lock mechanism 260 is exposed and accessible through an access aperture 214 in the square shaped door 200. By this attachment, assembly of the safe is completed.

It is also contemplated that the preassembled portion of the universal boltworks mechanism is also adapted for easy assembly without requiring special skills. In order to assemble the universal boltworks mechanism within the mounting enclosure 280, such a mounting enclosure or square pan must be provided which is manufactured or formed in the manner previously described. Each of the four bolt assemblies may be assembled by positioning the mounting arms 247 of each bolt inhibiting spring 241 within the inhibitor mounting apertures 286 of each of the bolt guide portions 282. While the inhibiting spring member 241 is depressed, overcoming its biasing force, a respective door frame engaging bolt 60 which has been selected or cut to size corresponding with the dimensions of the safe door is inserted into its respective bolt channel formed by the bolt receiving aperture 284 in the respective side portion 281 and the bolt guide portion 282 and is rotated such that its respective linkage aperture 67 is oriented upward. Once the bolt 60 has been inserted into its respective bolt receiving apertures 284, its respective inhibiting spring member 241 may be released. Similarly, the universal cam member may be positioned centrally in the mounting enclousre, the selected lock mechanism may be assembled in position within the protective skirt 50 of the universal cam member 10, assembly of the lock mechanism may be completed by the positioning of the lock mechanism driving cam 70 onto the completed lock mechanism. Assembly of the driving assembly is completed by dropping biasing spring 55 and then pawl 56 onto the mounting post 54 of the universal cam member 10. The overcenter spring 18 may be mounted to the universal cam member 10 and the mounting enclosuse 280. Each of the four bolt driving linkages 270 may then be inserted such that the bolt engaging pin 272 is seated in the linkage aperture 67 of the respective bolt 60 and the driving structure engaging pin 264 is seated in the aperture 46 of its respective bolt driving structure 42. Assembly is completed and made operational by the postioning of cover plate 220 such that each of the inhibitor spring displacing arms 239 extends through the rectangular cutouts 288 of mounting enclosure 280 into engagement with a bolt engaging portion 249 of each of the bolt inhibiting spring members 241 and the cover plate 220 is secured in place by the insertion of multiple mounting screws 224 which pass through the mounting apertures 222 of cover plate 220 and into cover plate mounting apertures 290 of mounting enclosure 280, thereby securing the cover plate 220 and the assembled boltworks mechanism within the mounting enclosure 280.

It can be seen in the foregoing description of the preferred embodiment of the universal cam member assembled within two configurations of the universal boltworks mechanism, each configuration adaptable for use with a variety of shapes and sizes of a safe door, that the various features, objects and advantages of the present invention are accomplished. Further, it will be apparent to one skilled in the art that various modifications, adaptations and variations of the foregoing features and configurations, many of which have been illustrated, may be made and still fall within the scope and spirit of the present invention. It is contemplated that the alternative embodiments and configurations of the various features of the present invention may, be with few exceptions, combined into numerous permutations of equally preferable alternative constructions of the universal boltworks mechanism. For example, the two alternatives embodiments of the bolt inhibitor feature of the present invention may each be used with either the square or round safe door with equal effectiveness. Similarly, assembly of the universal boltworks mechanism in either the first or second configuration, as will be described, may be applied with equal effectiveness to either the square or round safe door; only the number of bolts and driving structures assembled in accordance with the selected configuration will affected by the shape of the door. Therefore, while only two alternative constructions are shown in the drawings, they adequately illustrate alternative embodiments of each of the various features and, thus, it should be understood that each of these alternative embodiments is not limited in its application to the contextual construction configuration in which it appears. The few exceptions are that: an even-numbered plurality of door frame engaging assemblies are best suited for use with rectangular shaped safe doors and appropriately mounted in square enclosures, except that such an assembly may be as easily and effectively mounted in a cylindrically-shaped bore on the interior surface of a square-shaped safe door; an odd-numbered plurality of door frame engaging bolt assemblies are best suited for use with circular-shaped doors and appropriately mounted in a circular enclosure; and bolt driving structures in the form of inwardly spiraling grooves used with the second configuration are best formed on the side of the universal cam member which faces the safe door and lock mechanism in order to permit easy assembly. Accordingly, while exemplary embodiments of the present invention have been illustrated and described, the scope and spirit of the present invention is limited only by the following claims.

I claim:

1. A universal boltworks mechanism for use with a safe having a safe door mounted to a safe enclosure, said enclosure having a door frame, said safe door carrying a lock mechanism and multiple outwardly extending bolts for selectively engaging the door frame thereby locking the safe, said lock mechanism including a driving apparatus which rotates from a position associated with the safe being locked to a position associated with the safe being unlocked only in response to a preselected unlocking manipulation of said lock mechanism, the improved mechanism comprising a universal cam means driven by said lock mechanism driving apparatus for driving said multiple outwardly extending bolts to disengage the door frame in response to rotation of the driving apparatus to the unlocked position, said universal cam means being alternatively usable with safe doors of circular and quadrilateral configuration and comprising:

a cam member having a set of first multiple bolt driving portions on a first side thereof for use when said cam member is used in conjunction with a circular safe door and a set of second multiple bolt driving portions on a second side thereof for use when said cam member is used in conjunction with a quadrilateral safe door.

2. The universal boltworks mechanism of claim 1 wherein said universal cam means member is provided with three equiangularly displaced first multiple bolt driving portions proximate its periphery on said first side.

3. The universal boltworks mechanism of claim 1 or 2 wherein said universal cam means member is provided with four equiangularly displaced second multiple bolt driving portions proximate its periphery on said second side.

4. The universal boltworks mechanism of claim 1 further comprising a cover plate for enclosing said boltworks mechanism within said safe door and having break-away means for breaking away a portion of the cover plate whenever forces in excess of a predetermined threshold amount are experienced by any portion of the universal boltworks mechansim, said breaking away causing partial disassembly of the boltworks mechanism in a predetermined manner whereby the boltworks mechanism is substantially disabled in a door locked condition whenever the boltworks mechanism is drilled into, hammered upon, or blasted as in during an attempt theft of the safe contents.

5. The universal boltworks mechanism of claim 1 wherein said cam member includes a central sleeve portion about which tumbler wheels of said lock mechanism are rotatably mounted for manipulation by said preselected unlocking manipulation of said lock mechanism.

6. An improved boltworks mechanism for mounting on any size within a predetermined range of sizes of safe doors comprising mounting enclosure means for mounting the mechanism to the safe door, a lock mechanism enclosed in said mounting enclosure means and being partially accessible through an aperture in the safe door for unlocking manipulation, said lock mechanism including a driving shaft, a driving assembly rotated by said lock mechanism driving shaft in response to unlocking manipulation of the lock mechanism, a universal cam member mounted on said driving shaft and rotated by said driving assembly, multiple outwardly extending bolts for engaging a mating safe door frame and locking said safe door in a closed position with respect to said safe door frame, and bolt driving means for inwardly reacting said bolts thereby disengaging the safe door frame and unlocking said safe door in response to a predetermined rotation of the universal cam member, wherein said mounting enclosure further includes a cover plate having mounting apertures for mounting to the remainder of the boltworks mechanism enclosure, said cover plate normally serving to contain the universal boltworks mechanism within said mounting enclosure in an assembled and operational condition, said cover plate further having a breakaway portion which is isolated from said mounting apertures by grooves which form regions of reduced cross-section which are breakable whenever forces in excess of a predetermined threshold are exerted on substantially any portion of the boltworks mechanism as during improper tampering with the safe whereby the breakaway portion of the cover plate in response to said forces is broken away causing a predetermined disassembly of the universal boltworks mechanism in a manner which disables the mechanism in a safe locked condition.

7. The improved boltworks mechanism of claim 6 further including the provision of bolt inhibitor means for inhibiting movement of a respective door frame engaging bolt from the frame engaged position whenever said breakaway portion has been broken away.

8. A universal cam member for use with a lock mechanism having a driving shaft and carried by a safe door having multiple outwardly extending door frame engaging bolts, said universal cam member comprising a single-piece having an aperture for journal mounting the cam member to said driving shaft, and multiple bolt driving portions proximate its periphery for driving bolts which are sizeable for use with any size and shape within a predetermined range of sizes and shapes of safe door, wherein one side of the member includes a plurality of equiangularly displaced first bolt driving portions proximate its periphery for use when the universal cam member is used in conjunction with a circular safe door and wherein the other side of the member includes a plurality of equiangularly displaced second bolt driving portions proximate its periphery for use when the universal cam member is used in conjunction with a quadrilateral safe door.

9. The universal cam member of claim 8 wherein the first bolt driving portions each comprise an inwardly spiraling groove for engaging a bolt-associated pin whereby rotation of the universal cam member causes each bolt-associated pin and its respective bolt to be moved inwardly and outwardly as the pin tracks in its respective spiral groove.

10. The universal cam member of claim 9 further including multiple bolts each having pins for insertion into and engagement with a respective groove of the universal cam member.

11. The universal cam member of claim 9 wherein three equiangularly displaced inwardly spiraling grooves are provided for engaging three bolt-associated pins and thereby driving three bolts mounted equiangularly on a circular safe door.

12. The universal cam member of claim 8 wherein the second bolt driving portions each comprise an aperture and further include bolt driving means pivotally mounted to a respective bolt and having a pivot pin portion for insertion into said aperture for pivoting said bolt driving means relative to the universal cam member and thereby linking said universal cam member to each respective bolt whereby rotation of the universal cam member causes each bolt to move inwardly and outwardly.

13. The universal cam member of claim 12 wherein four equiangularly displaced bolt driving apertures are provided for engaging a pivot pin portion of each of four bolt driving means and thereby driving respectively four bolts mounted equiangularly on a rectangular safe door.

14. The apparatus of claim 13 wherein said rectangular safe door is square.

15. A universal boltworks mechanism for use with any dimension of circular safe door within a predetermined range of dimensions and, alternatively, for use with any dimension of rectangular safe door within a predetermined range of dimensions, said safe door having a centrally located interior bore of a predetermined diameter, a coaxial aperture of a predetermined diameter extending from the interior bore to the exterior surface, and multiple equiangularly displaced apertures extending radially outward from said interior bore, said universal boltworks mechanism comprising:

a lock mechanism having a manipulable portion accessable to the exterior of the safe door through said coaxial aperture;

cam driving means rotated by said lock mechanism whenever the manipulable portion has been manipulated in a predetermined manner associated with unlocking the safe;

multiple bolts each slidably mounted in one of said radial apertures for limited movement radially inward and outwardly with respect to the safe door and having a length corresponding to the dimension of the safe door such that said limited movement selectively engages the safe door frame thereby locking and unlocking the door, the radially inward portion of each bolt being provided with a bolt-associated pin;

a universal cam member integral with said cam driving means and having a lock mechanism protective fence portion extending circumferentially about the lock mechanism adjacent to and radially inward of said interior born, three equiangularly displaced inwardly spiraling grooves proximate the periphery of one side of the universal cam member for engaging three bolt-associated pins and thereby driving three bolts mounted equiangularly on a circular safe door, and four equiangularly displaced bolt driving apertures proximate the periphery of the other side of the universal cam member, each for engaging a pivot pin portion of a bolt driving link pivotedly mounted to a respective bolt and thereby driving four bolts mounted equiangularly on a square safe door; and a cover plate for enclosing said boltworks mechanism within said interior bore and having break-away means for breaking away a portion of the cover plate whenever forces in excess of a predetermined threshold amount are experienced by any portion of the universal boltworks mechanism, said breaking away causing partial disassembly of the boltworks mechanism in a predetermined manner whereby the boltworks mechanism is substantially disabled in a door locked condition whenever the boltworks mechanism is drilled into, hammered upon, or blasted as in during an attempted theft of the safe contents.

16. A universal cam member for use with a lock mechanism having a driving shaft and carried by a safe door having multiple outwardly extending door frame engaging bolts, said universal cam member comprising a single-piece having an aperture for journal mounting the cam member to said driving shaft, and multiple bolt driving portions proximate its periphery for driving bolts which are sizeable for use with any size and shape within a predetermined range of sizes and shapes of safe door, wherein one side of the member includes three equiangularly displaced first bolt driving portions proximate its periphery for use when the universal cam member is used in conjunction with a circular safe door and wherein the other side of the member includes four equiangularly displaced second bolt driving portions proximate its periphery for use when the universal cam member is used in conjunction with a quadrilateral safe door.

* * * * *